US008081144B2

(12) United States Patent
Origuchi et al.

(10) Patent No.: US 8,081,144 B2
(45) Date of Patent: Dec. 20, 2011

(54) PLASMA DISPLAY PANEL DRIVE METHOD AND PLASMA DISPLAY DEVICE

(75) Inventors: Takahiko Origuchi, Osaka (JP); Hidehiko Shoji, Osaka (JP); Mitsuo Ueda, Hyogo (JP)

(73) Assignee: Panasonic Corporation, Osaka (JP)

( * ) Notice: Subject to any disclaimer, the term of this patent is extended or adjusted under 35 U.S.C. 154(b) by 604 days.

(21) Appl. No.: 12/088,762

(22) PCT Filed: Feb. 26, 2007

(86) PCT No.: PCT/JP2007/053507
§ 371 (c)(1),
(2), (4) Date: Mar. 31, 2008

(87) PCT Pub. No.: WO2007/099904
PCT Pub. Date: Sep. 7, 2007

(65) Prior Publication Data

US 2009/0231317 A1 Sep. 17, 2009

(30) Foreign Application Priority Data

Feb. 28, 2006 (JP) ..... 2006-051735

(51) Int. Cl.
*G09G 3/28* (2006.01)

(52) U.S. Cl. ..... 345/60; 345/211; 315/169.4

(58) Field of Classification Search ..... 345/60–72, 345/211; 315/169.4
See application file for complete search history.

(56) References Cited

U.S. PATENT DOCUMENTS

2002/0050794 A1 5/2002 Ishizuka
2003/0189533 A1* 10/2003 Myoung et al. ..... 345/67
2003/0201726 A1* 10/2003 Kang et al. ..... 315/169.1
2004/0080280 A1 4/2004 Hibino et al.
2005/0110713 A1* 5/2005 Chung et al. ..... 345/60

(Continued)

FOREIGN PATENT DOCUMENTS

EP 1022715 A2 * 7/2000

(Continued)

OTHER PUBLICATIONS

International Search Report for PCT/JP2007/053507, dated Apr. 3, 2007.

(Continued)

*Primary Examiner* — Alexander Eisen
*Assistant Examiner* — Sanjiv D Patel
(74) *Attorney, Agent, or Firm* — RatnerPrestia

(57) ABSTRACT

A plasma display panel is driven by providing a plurality of subfields within one field period, the subfield having an initializing period in which the initializing discharge is generated in a discharge cell by applying a ramp-waveform voltage that is gradually descending to a scan electrode, an address period in which an address discharge is generated in the discharge cell by applying a scan pulse voltage to the scan electrode, and a sustain period in which sustain discharges by the number of times corresponding to the luminance weight are generated in the selected discharge cell. The lowest voltage is set of the descending ramp-waveform voltage in the subfield where the luminance weight is the smallest lower than the same voltage in the subfield where the luminance weight is the largest, and a voltage is kept for a prescribed period after the descending ramp-waveform voltage reaches the lowest voltage in the subfield where the luminance weight is the smallest.

2 Claims, 13 Drawing Sheets

U.S. PATENT DOCUMENTS

| | | | | |
|---|---|---|---|---|
| 2006/0290599 | A1* | 12/2006 | Yoo | 345/60 |
| 2007/0152916 | A1* | 7/2007 | Kim et al. | 345/67 |

FOREIGN PATENT DOCUMENTS

| | | | |
|---|---|---|---|
| EP | 1 550 998 | A2 | 7/2005 |
| EP | 1 806 719 | A2 | 7/2007 |
| JP | 2000-242224 | A | 9/2000 |
| JP | 2000-267625 | A | 9/2000 |
| JP | 2002-14650 | A | 1/2002 |
| JP | 2004-109838 | A | 4/2004 |
| KR | 2005-0050826 | | 6/2005 |

OTHER PUBLICATIONS

Supplementary European Search Report for Application No. EP 07 71 4939, Nov. 2, 2009, Panasonic Corportion.

* cited by examiner

PLASMA DISPLAY PANEL DRIVE METHOD AND PLASMA DISPLAY DEVICE

This application is a U.S. National Phase Application of PCT International Application PCT/JP2007/053507.

TECHNICAL FIELD

The present invention relates to a plasma display panel drive method used in a wall hanging television and a large monitor and a plasma display device.

BACKGROUND ART

In an AC surface discharge type panel that is typical as a plasma display panel (in the following, abbreviated as a "panel"), a large number of discharge cells are formed between a front substrate and a rear substrate arranged facing each other. In the front substrate, a plurality of display electrode pairs each consisting of one pair of a scan electrode and a sustain electrode are formed in parallel to each other on a front surface glass substrate, and a dielectric layer and a protective layer are formed to cover these display electrode pairs. In the rear substrate, a plurality of parallel data electrodes are formed on a back surface glass substrate, a dielectric layer is formed to cover these, and on top of it, a plurality of barrier ribs are formed in parallel to the data electrodes, and a phosphor layer is formed on the surface of the dielectric layer and a side surface of the barrier rib. The front substrate and the rear substrate are arranged facing each other so that the display electrode pair and the data electrode stereoscopically intersect, are sealed, and a discharge gas containing 5% of xenon at a partial pressure ratio, for example, is sealed in a discharge space in the inside. Here, a discharge cell is formed in a part where the display electrode pair and the data electrode are facing each other. In a panel with such configuration, color display is performed by generating an ultraviolet ray by gas discharge in each discharge cell and exciting a phosphor each having a color of red (R), green (G), and blue (B) to emit light.

A subfield method, that is, a method of dividing one field period into a plurality of subfields and then performing display gradation by a combination of the subfields to emit light, is a general method of driving the panel. Each subfield has an initializing period, an address period, and a sustain period, generates an initializing discharge in the initializing period, and forms wall charges that are necessary for the subsequent writing operation on each electrode. In the address period, address discharges are generated selectively in a discharge cell that performs a display, and the wall charges are formed. Then, in the sustain period, a sustain pulse is applied alternately on the display electrode pair consisting of the scan electrode and the sustain electrode, a sustain discharge in the discharge cell where the address discharge was generated is generated, and image display is performed by making the phosphor layer of the corresponding discharge cell emit light.

Further, also in the subfield method, a drive method is disclosed in which the contrast ratio is improved by decreasing emission that does not relate to the display gradation as much as possible by performing the initializing discharge using a voltage waveform that changes gradually and further performing the initializing discharge selectively to the discharge cell where the sustain discharge is performed.

Specifically, the operation of initializing all cells is performed in which all discharge cells are discharged in the initializing period of one subfield among a plurality of subfields, and a selected initializing operation is performed in which only a discharge cell in which the sustain discharge is performed is initialized in the initializing period of other subfields. As a result, emission that is not related to a display becomes only emission accompanied by the discharge of the all cell initializing operation, and image display with high contrast becomes possible (for example, refer to Patent Document 1).

By driving in such way, luminance in the black display region that changes depending on emission that is not related to the display of an image becomes only faint emission in the all cell initializing operation, and image display with high contrast becomes possible.

However, in recent years, a panel has been made into a larger screen to achieve high definition, and because of that, the address discharge becomes unstable, the wiring discharge is not generated in the discharge cell where the display is supposed to be performed, and the quality of the image display is deteriorated, or the voltage that is necessary to generate the address discharge stably becomes high.

Patent Document 1: Unexamined Japanese Patent Publication No. 2000-242224

DISCLOSURE OF THE INVENTION

The present invention provides a drive method of a panel with a good image display quality that generates a stable address discharge without requiring the voltage necessary to generate the address discharge to be high even in a large screen and a high luminance panel and a plasma display device.

The present invention is a drive method of a panel equipped with a plurality of discharge cells having a display electrode pair consisting of a scan electrode and a sustain electrode, and has a step of providing a plurality of subfields within one field period, the subfield having an initializing period in which a ramp waveform voltage that is gradually descending is applied to the scan electrode, an address period in which an address discharge is generated in a discharge cell by applying a scan pulse voltage to the scan electrode, and a sustain period in which a sustain discharge is generated in the selected discharge cell by alternately applying sustain pulse voltages to the display electrode pair by the number of times corresponding to the luminance weight, and a step of keeping a voltage for a prescribed period after the descending ramp-waveform voltage reaches to the lowest voltage in the initializing period.

With this, voltage adjustment of the lowest voltage of the descending ramp-waveform voltage is made to be performed easily, and a stable address discharge can be generated without making the voltage necessary to generate an address discharge high even in a large screen and a high luminance panel.

Further, in the drive method of a panel of the present invention, the lowest voltage of the descending ramp-waveform voltage in the subfield where the luminance weight is smallest is configured so as to become lower than the lowest voltage of the descending ramp-waveform voltage in the subfield where the luminance weight is largest, and it is desirable that a voltage is kept for a prescribed period after the descending ramp-waveform voltage reaches the lowest voltage in the initializing period of the subfield where the luminance weight is smallest.

Further, the drive method of a panel of the present invention has an all cell initializing subfield in which the initializing discharge is generated for all discharge cells performing image display in the initializing period and a selected initializing subfield selectively generating the initializing discharge at the discharge cell in which a sustain discharge is generated in the subfield right before in the initializing period, and it is desirable to make the subfield where the luminance weight is the smallest be the all cell initializing subfield and the subfield where the luminance weight is the largest be the selected initializing subfield.

Further, the plasma display device of the present invention is characterized by being equipped with a panel equipped with a plurality of discharge cells having a display electrode pair consisting of a scan electrode and a sustain electrode, and a driving circuit driving a panel by providing a plurality of subfields within one field period, the subfield having an initializing period in which a ramp-waveform voltage that is gradually descending is applied to the scan electrode, an address period in which an address discharge is generated in a discharge cell, and a sustain period in which a sustain discharge is generated in the selected discharge cell by alternately applying sustain pulse voltages to the display electrode pair by the number of times corresponding to the luminance weight, and is characterized in that the driving circuit is configured to keep a voltage for a prescribed period after the descending ramp-waveform voltage reaches to the lowest voltage in the initializing period.

With this, voltage adjustment of the lowest voltage of the descending ramp-waveform voltage is made to be performed easily, and a stable address discharge can be generated without making the voltage necessary to generate an address discharge high even in a large screen and a high luminance panel.

Further, in the plasma display device of the present invention, it is desirable that the driving circuit is configured so that the lowest voltage of the descending ramp-waveform voltage in the subfield where the luminance weight is the smallest is lower than the lowest voltage of the descending ramp-waveform voltage in the subfield where the luminance weight is the largest, and to keep a voltage for a prescribed period after the descending ramp-waveform voltage reaches the lowest voltage in the initializing period of the subfield where the luminance weight is the smallest.

REFERENCE MARKS IN THE DRAWINGS

1 PLASMA DISPLAY DEVICE
10 PANEL
21 GLASS FRONT SUBSTRATE
22 SCAN ELECTRODE
23 SUSTAIN ELECTRODE
24, 33 DIELECTRIC LAYER
25 PROTECTIVE LAYER
28 DISPLAY ELECTRODE PAIR
31 REAR SUBSTRATE
32 DATA ELECTRODE
34 BARRIER RIB
35 PHOSPHOR LAYER
51 IMAGE SIGNAL PROCESS CIRCUIT
52 DATA ELECTRODE DRIVING CIRCUIT
53 SCAN ELECTRODE DRIVING CIRCUIT
54 SUSTAIN ELECTRODE DRIVING CIRCUIT
55 TIMING GENERATING CIRCUIT
100, 200 SUSTAIN PULSE GENERATING CIRCUIT
110 POWER COLLECTING CIRCUIT
300 INITIALIZING WAVEFORM GENERATING CIRCUIT
310, 320 MILLER INTEGRATION CIRCUIT
400 SCAN PULSE GENERATING CIRCUIT
SW1, SW2, S31, S32 SWITCHING ELEMENT
FET1, FET2 FET
C1, C2 CAPACITOR
R1, R2 RESISTANCE
IN1, IN2 INPUT TERMINAL
CP COMPARATOR
AG AND GATE

DETAILED DESCRIPTION OF THE PREFERRED EMBODIMENTS

In the following, the plasma display device in an embodiment of the present invention is described with reference to the drawings.

Embodiment 1

Figure 1:
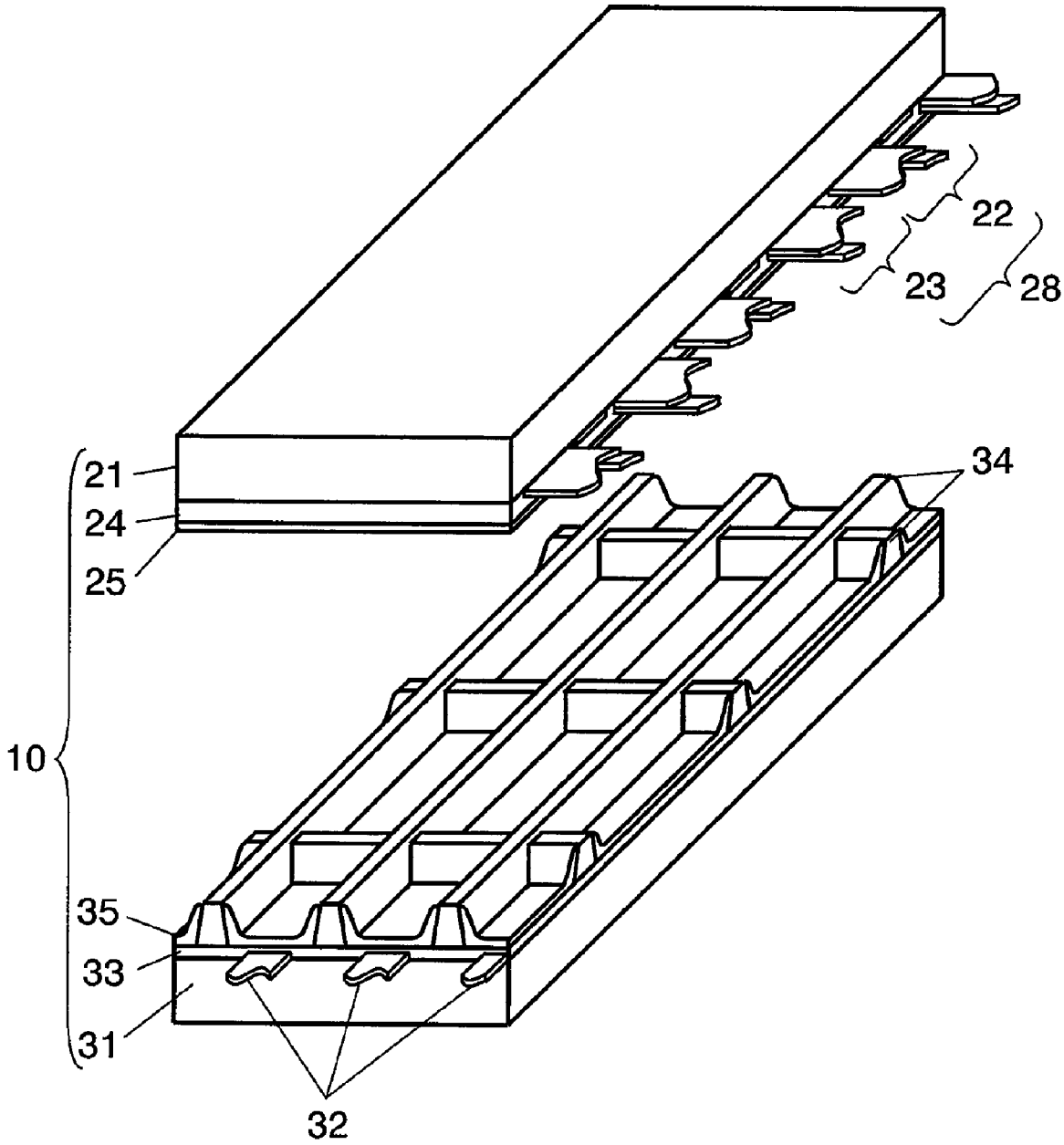
FIG. 1 is an exploded perspective view showing the structure of a panel in Embodiment 1 of the present invention.

FIG. 1 is an exploded perspective view showing the structure of panel 10 in Embodiment 1 of the present invention. A plurality of display electrode pairs 28 consisting of scan electrode 22 and sustain electrode 23 are formed on glass front substrate 21. Dielectric layer 24 is formed so as to cover scan electrode 22 and sustain electrode 23, and protective layer 25 is formed on dielectric layer 24. A plurality of data electrodes 32 are formed on rear substrate 31, dielectric layer 33 is formed so as to cover data electrodes 32, and further barrier rib 34 of a curb shape is formed on top of it. In addition, phosphor layer 35 that emits light of each color of red (R), green (G), and blue (B) is provided on the side surface of barrier rib 34 and dielectric layer 33.

These front substrate 21 and rear substrate 31 are arranged facing each other so that display electrode pair 28 and data electrode 32 intersect sandwiching a very small discharge space therebetween, and the peripheral part is sealed with a sealing material such as a glass frit. A mixed gas of neon and xenon, for example, is sealed in the discharge space as the discharge gas. In Embodiment 1, a discharge gas in which a partial pressure of xenon is made to be 10% is used for the improvement of the luminance. The discharge space is partitioned into a plurality of sections by barrier rib 34, and the discharge cell is formed in a part where display electrode pair 28 and data electrode 32 intersect. An image is displayed by these discharge cells discharging and emitting light.

The structure of the panel is not limited to the one described above, and it may be a structure equipped with a stripe-shaped barrier rib, for example.

Figure 2:
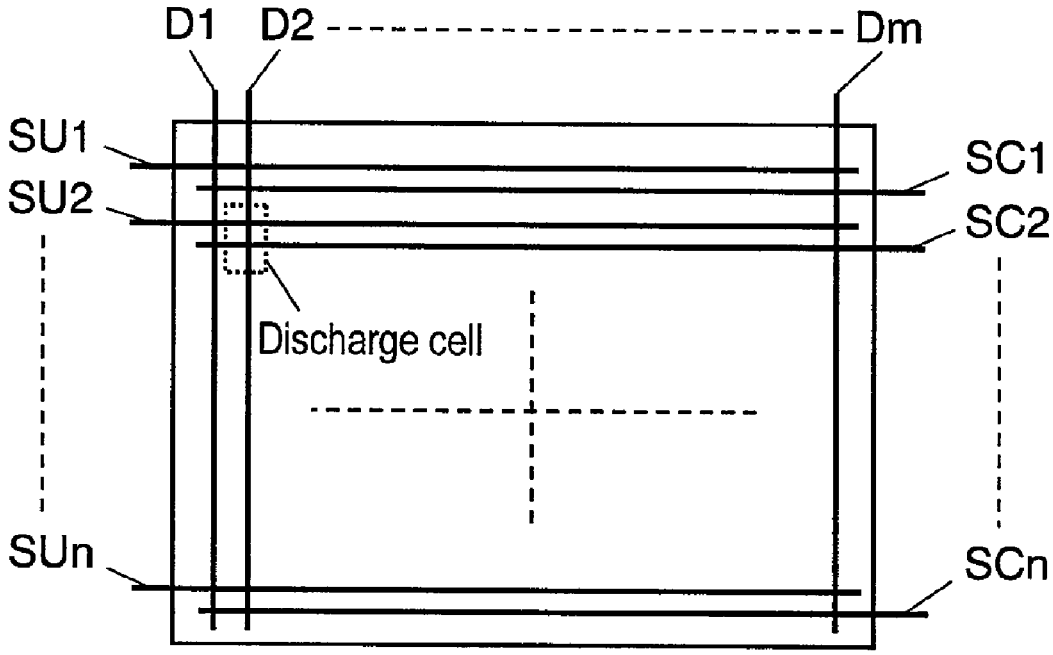
FIG. 2 is an electrode arrangement drawing of the panel in Embodiment 1 of the present invention.

FIG. 2 is an electrode arrangement drawing of panel 10 in Embodiment 1 of the present invention. In panel 10, n pieces of scan electrodes SC1 to SCn (scan electrode 22 in FIG. 1) that are long in the column direction and n pieces of sustain electrodes SU1 to SUn (sustain electrode 23 in FIG. 1) are arranged, and m pieces of data electrodes D1 to Dm (data electrode 32 in FIG. 1) that are long in the row direction are arranged. A discharge cell is formed in a part where a pair of scan electrodes SCi (i=1 to n) and sustain electrode SUi (i=1 to n), and one data electrode Dj (j=1 to m) intersect, and m×n discharge cells are formed in the discharge space. Moreover, because scan electrode SCi and sustain electrode SUi are formed in a pair parallel to each other as shown in FIGS. 1 and 2, a large inter-electrode capacity Cp exists between scan electrodes SC1 to SCn and sustain electrodes SU1 to SUn.

Figure 3:
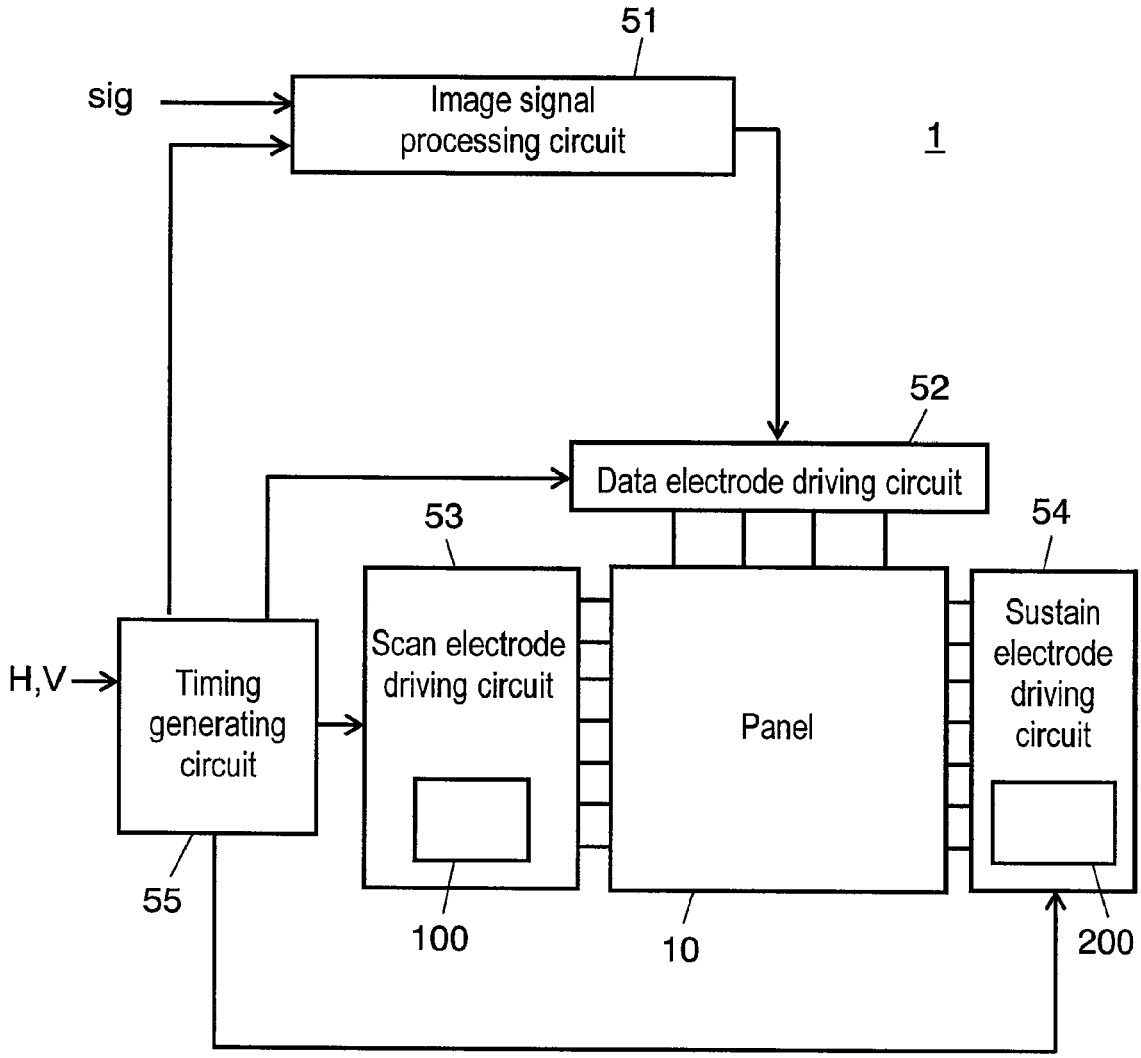
FIG. 3 is a circuit block diagram of the plasma display device in Embodiment 1 of the present invention.

FIG. 3 is a circuit block diagram of plasma display device 1 in Embodiment 1 of the present invention. Plasma display device 1 is equipped with panel 10, image signal processing circuit 51, data electrode driving circuit 52, scan electrode driving circuit 53, sustain electrode driving circuit 54, timing generating circuit 55, and a power circuit (not shown) to supply a necessary power to each circuit block.

Image signal processing circuit 51 converts an input image signal sig into image data showing emission and non-emission in each subfield. Data electrode driving circuit 52 converts the image data in each subfield into a signal corresponding to each data electrode D1 to Dm, and drives each data electrode D1 to Dm.

Timing generating circuit 55 generates various timing signals that control the operation of each circuit block based on a horizontal synchronizing signal H and a vertical synchronizing signal V, and supplies the signals to each circuit block. Scan electrode driving circuit 53 has sustain pulse generating circuit 10 to generate a sustain pulse that is applied to scan electrodes SC1 to SCn in the sustain period, and drives each scan electrode SC1 to SCn respectively based on the timing signal. Sustain electrode driving circuit 54 has a circuit that applies a voltage Ve1 to sustain electrodes SU1 to SUn in the initializing period and sustain pulse generating circuit 200 to generate a sustain pulse that is applied to sustain electrodes SU1 to SUn in the sustain period, and drives sustain electrodes SU1 to SUn based on the timing signal.

Next, the driving voltage waveform to drive panel 10 and its operation are described. Plasma display device 1 performs a subfield method, that is, a method in which one field period is divided into a plurality of subfields and display gradation is performed by controlling emission and non-emission of each discharge cell in each subfield. Each subfield has an initializing period, an address period, and a sustain period. In the initializing period, the initializing discharge is generated and wall charges that are necessary for the subsequent address discharge are formed on each electrode. The initializing operation at this time is an initializing operation that generates the initializing discharge at all discharge cells (in the following, abbreviated as an "all cell initializing operation") or an initializing operation that generates the initializing discharge at a discharge cell where the sustain discharge was performed (in the following, abbreviated as a "selected initializing operation"). In the address period, address discharges are generated selectively in a discharge cell to emit light, and the wall charges are formed. Then, in the sustain period, a number of sustain pulses that is proportional to the luminance weight are applied alternately to the display electrode pair, and light is emitted by generating a sustain discharge in the discharge cell where the address discharge was generated. The proportional constant at this time is called the luminance magnification. Details of the subfield configuration are described later, and the drive voltage waveform and its operation in the subfield are described here.

Figure 4:
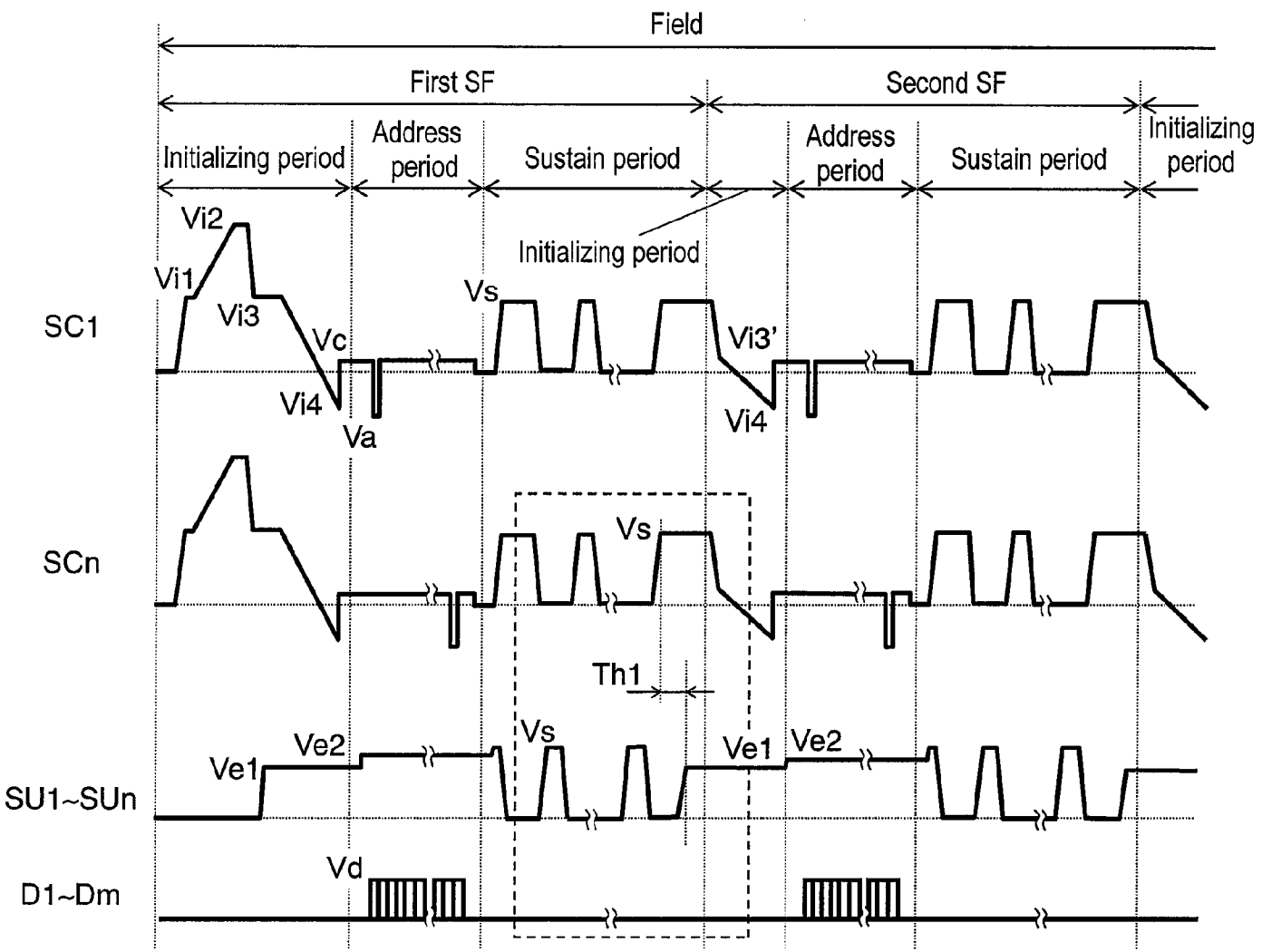
FIG. 4 is a waveform drawing of the driving voltage that is applied to each electrode in the panel in Embodiment 1 of the present invention.

FIG. 4 is a waveform drawing of the driving voltage that is applied to each electrode in panel 10 in Embodiment 1 of the present invention. A subfield that performs the all cell initializing operation and a subfield that performs the selected initializing operation are shown in FIG. 4.

First, the subfield that performs the all cell initializing operation is described.

In the first half of the initializing period, a voltage 0 V is applied on each of data electrodes D1 to Dm and sustain electrodes SU1 to SUn, and a ramp-waveform voltage (in the following, referred to as an "ascending ramp waveform voltage") that is gradually ascending from voltage Vi1 that is a discharge initial voltage or less toward voltage Vi2 that exceeds the discharge initial voltage is applied to scan electrodes SC1 to SCn relative to sustain electrodes SU1 to SUn. While this ramp-waveform voltage ascends, a very weak initializing discharge occurs between each of scan electrodes SC1 to SCn and sustain electrodes SU1 to SUn, and data electrodes D1 to Dm. While a negative wall voltage is accumulated on the top part of scan electrodes SC1 to SCn, a positive wall voltage is accumulated on the top part of data electrodes D1 to Dm and the top part of sustain electrodes SU1 to SUn. Here, the wall voltage of the top part of the electrode represents a voltage generated by the wall charges accumulated on the dielectric layer, the protective layer, the phosphor layer, and the like covering the electrode.

In the latter half of the initializing period, a positive voltage Ve1 is applied to sustain electrodes SU1 to SUn, and a ramp-waveform voltage (in the following, referred to as a "descending ramp waveform voltage") that is gradually descending from voltage Vi3 that is a discharge initial voltage or less toward voltage Vi4 that exceeds the discharge initial voltage is applied to scan electrodes SC1 to SCn relative to sustain electrodes SU1 to SUn (in the following, the minimum value of the descending ramp waveform voltage applied to scan electrodes SC1 to SCn is referred to as "initializing voltage Vi4"). During this time, a very weak initializing discharge occurs between each of scan electrodes SC1 to SCn and sustain electrodes SU1 to SUn, and data electrodes D1 to Dm.

Then, the negative wall voltage on the top part of scan electrodes SC1 to SCn and the positive wall voltage on the top part of sustain electrodes SU1 to SUn are weakened, and the positive wall voltage on the top part of data electrodes D1 to Dm is adjusted to a value that is appropriate for the writing operation. With the above, the all cell initializing operation performing the initializing discharge to all discharge cells is finished.

Here, the initializing discharge generated by applying the descending ramp waveform voltage to scan electrodes SC1 to SCn has the function of weakening the wall voltage on the top part or data electrodes D1 to Dm. Therefore, the wall voltage on the top part of data electrodes D1 to Dm changes corresponding to the voltage value of initializing voltage Vi4 at which the descending ramp waveform voltage is the lowest, and when the voltage value of initializing voltage Vi4 is increased, the function of weakening the wall voltage is weakened and the wall voltage on the top part of data electrodes D1 to Dm becomes high, and when the voltage value of initializing voltage Vi4 is decreased, the function of weakening the wall voltage is strengthened and the wall voltage on the top part of data electrodes D1 to Dm becomes low. The present Embodiment 1 has a configuration in which the voltage value of initializing voltage Vi4 is switched with two different voltage values corresponding to the luminance weight. In the following, the higher voltage value is described as Vi4H and the lower voltage value is described as Vi4L. Moreover, details of this operation will be described later.

In the subsequent address period, voltage Ve2 is applied to sustain electrodes SU1 to SUn, and voltage Vc is applied to scan electrodes SC1 to SCn.

Next, while applying negative scan pulse voltage Va to scan electrode SC1 of a first column, positive writing pulse voltage Vd is applied to data electrodes Dk (k=1 to m) of the discharge cell that have to emit light in the first column among data electrodes D1 to Dm. At this time, the difference in the voltage at the intersection part of the top of data electrode Dk with the top of scan electrode SC1 becomes one in which the difference of the wall voltage on data electrode Dk with the wall voltage on scan electrode SC1 is added to the difference of the externally applied voltages (Vd−Va), and exceeds the discharge initial voltage. Then, the address discharge occurs between data electrode Dk and scan electrode SC1 and between sustain electrode SU1 and scan electrode SC1, a positive wall voltage is accumulated on scan electrode SC1, a negative wall voltage is accumulated on sustain electrode SU1, and a negative wall voltage is also accumulated on data electrode Dk.

In such way, the address discharge is generated at the discharge cell that has to emit light in the first column, and the writing operation that accumulates the wall voltage on each electrode is performed. On the other hand, because the voltage at the intersection part of data electrodes D1 to Dm in which writing pulse voltage Vd was not applied and scan electrode SC1 does not exceed the discharge initial voltage, the writing voltage is not generated. The above writing operation is performed to the discharge cell in the nth column of scan electrode SCn, and the address period is finished.

In the subsequent sustain period, driving is performed using a power collecting circuit in order to reduce power consumption. First, a voltage 0 V is applied to sustain electrodes SU1 to SUn together with positive sustain pulse voltage Vs to scan electrodes SC1 to SCn. Then, in the discharge cell in which the address discharge occurred, the difference in the voltage on scan electrode SCi with the top of sustain electrode SUi becomes one in which the difference of the wall voltage on scan electrode SCi with the wall voltage on sustain electrode SUi is added to sustain pulse voltage Vs, and it exceeds the discharge initial voltage. Then, the sustain discharge occurs between scan electrode SCi and sustain electrode SUi, and phosphor layer 35 emits light by ultraviolet rays generated at this time. Then, a negative wall voltage is accumulated on scan electrode SCi, and a positive wall voltage is accumulated on sustain electrode SUi. Furthermore, a positive wall voltage is also accumulated on data electrode Dk. In the address period, in the discharge cell in which the address discharge did not occur, the sustain discharge is not generated, and the wall voltage at the completion of the initializing period is kept.

Subsequently, a voltage 0 V is applied to scan electrodes SC1 to SCn and sustain pulse voltage Vs is applied to sustain electrodes SU1 to Sun, respectively. Then, because the difference in the voltage on sustain electrode SUi and on scan electrode SCi exceeds the discharge initial voltage in the discharge cell in which the sustain discharge was generated, the sustain discharge occurs again between sustain electrode SUi and scan electrode SCi, and a negative wall voltage is accumulated on sustain electrode SUi and a positive wall voltage is accumulated on scan electrode SCi. As above, the sustain discharge is continuously performed in the discharge cell in which the address discharge occurs in the address period by alternately applying a number of sustain pulses in which the luminance weight is multiplied by the luminance magnification to scan electrode SC1 to SCn and sustain electrodes SU1 to SUn and by giving a voltage difference between electrodes of the display electrode pair.

Then, at the end of the sustain period, the wall voltage on scan electrode SCi and sustain electrode SUi is eliminated by giving a so-called narrow width pulse form voltage difference between scan electrodes SC1 to SCn and sustain electrodes SU1 to SUn while a positive wall voltage remains on data electrode Dk. Specifically, after once returning sustain electrodes SU1 to SUn to a voltage 0 V, sustain pulse voltage Vs is applied to scan electrodes SC1 to SCn. Then, the sustain discharge occurs between sustain electrode SUi of the discharge cell in which the sustain discharge occurs and scan electrode SCi. Then, before this discharge is concluded, that is, while charged particles generated at the discharge sufficiently remains in the discharge space, voltage Ve1 is applied to sustain electrodes SU1 to SUn. With this, the difference in the voltage between sustain electrode SUi and scan electrode SCi is weakened to about the level of (Vs−Ve1). Then, while positive wall charges remain on data electrode Dk, the wall voltage between scan electrodes SC1 to SCn and sustain electrodes SU1 to SUn is weakened to about the level of the difference in voltage (Vs−Ve1) applied to each electrode. In the following, this discharge is called an "elimination discharge".

In such way, voltage Vs to generate the last sustain discharge, that is, an elimination discharge is applied to scan electrodes SC1 to SCn, and after a prescribed time interval (in the following, referred to as "elimination phase difference Th1"), voltage Ve1 to relax the difference in the voltage between the electrodes of the display electrode pair is applied to sustain electrodes SU1 to SUn. In this way, the sustain operation in the sustain period is finished.

Next, the operation of the subfield in which the selected initializing operation is performed is described.

In the initializing period in which the selected initializing operation is performed, voltage Ve1 is applied to sustain electrodes SU1 to SUn and a voltage 0 V is applied to data electrodes D1 to Dm respectively, and the descending ramp waveform voltage that is gradually descending from voltage Vi3' toward voltage Vi4 is applied to scan electrodes SC1 to SCn. In this case, a very weak initializing discharge occurs in the discharge cell in which the sustain discharge occurs in the sustain period of the previous subfield, and the wall voltage on scan electrode SCi and on sustain electrode SUi is weakened. Further, because a sufficient positive wall voltage is accumulated on data electrode Dk by the sustain discharge just before for data electrode Dk, an excess part of this wall voltage is discharged and adjusted to the wall voltage that is appropriate for the writing operation. On the other hand, for the discharge cell in which the sustain discharge did not occur in the previous subfield, the discharge is not generated and the wall charges at the completion of the initializing period of the previous subfield are kept as they are. In such way, the selected initializing operation is an operation of performing the initializing discharge selectively to the discharge cell in which the sustain operation was performed in the sustain period of the subfield right before.

Here also, the initializing discharge generated by applying the descending ramp waveform voltage to scan electrodes SC1 to SCn has the function of weakening the wall voltage on the top part of data electrodes D1 to Dm. Therefore, the wall voltage on the top part of data electrodes D1 to Dm changes corresponding to the voltage value of initializing voltage Vi4 at which the descending ramp waveform voltage is the lowest, when the voltage value of initializing voltage Vi4 is increased, the function of weakening the wall voltage is weakened and the wall voltage on the top part of data electrodes D1 to Dm becomes high, and when the voltage value of initializing voltage Vi4 is decreased, the function of weakening the wall voltage is strengthened and the wall voltage on the top part of data electrodes D1 to Dm becomes low. The present Embodiment 1 has a configuration in which the voltage value of initializing voltage Vi4 is switched between two different voltage values, Vi4H of the higher voltage value and Vi4L of the lower voltage value, corresponding to the luminance weight similarly to the descending ramp waveform voltage in the all cell initializing operation.

An explanation of the operation of the subsequent address period is omitted because it is the same as the operation of the address period of the subfield performing the all cell initializing operation, and the operation of the subsequent sustain period is also the same except the number of the sustain pulses.

Figure 5:
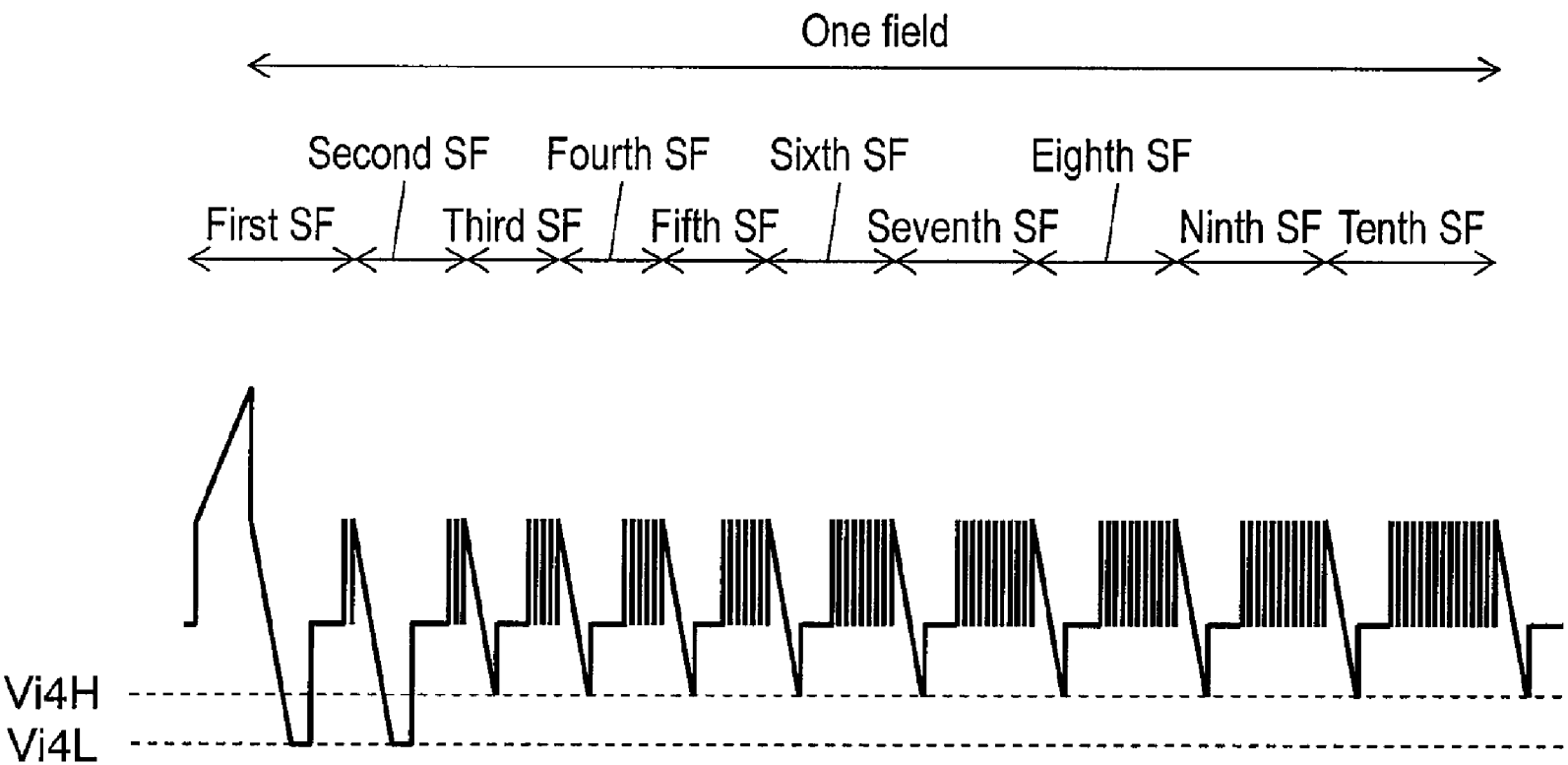
FIG. 5 is a drawing showing the subfield configuration in Embodiment 1 of the present invention.

Next, a subfield configuration is described. FIG. 5 is a drawing showing the subfield configuration in Embodiment 1 of the present invention. FIG. 5 briefly shows a driving waveform within one field in the subfield method, and the driving waveform of each subfield is equivalent to the driving waveform in FIG. 4.

In the present Embodiment 1, one field is divided into 10 subfields (first SF, second SF, . . . , and tenth SF), and each subfield has the luminance weight of (1, 2, 3, 6, 11, 18, 30, 44, 60, and 80) respectively, for example.

Further, in the sustain period of each subfield, a number of the sustain pulses in which the luminance weight of each subfield is multiplied by a prescribed luminance magnification is applied to each electrode of the display electrode pair.

Then, in the present Embodiment 1, the all cell initializing operation is performed in the initializing period of first SF, and the selected initializing operation is performed in the initializing period of second SF to tenth SF.

However, the number of the subfields and the luminance weight of each subfield are not limited to the above-described values in the present invention. A configuration of switching the subfield configuration based on the image signal or the like is also possible.

Here, in the present Embodiment 1, a stable address discharge is realized by setting the lowest voltage of the descending ramp waveform voltage in the subfield in which the luminance weight is the smallest lower than the lowest voltage of the descending ramp waveform voltage in the subfield in which the luminance weight is the largest.

Specifically, as shown in FIG. 5, initializing voltage Vi4 of the descending ramp waveform voltage in second SF in which the luminance weight is the second smallest to first SF in which the luminance weight is the smallest is set to be Vi4L, and initializing voltage Vi4 of the descending ramp waveform voltage in third SF to tenth SF other than the above is set to be Vi4H that is higher than Vi4L. Next, the reason is described.

In the following, the address discharge is described. However, because the address discharge is generated from the discharge between data electrode 32 and scan electrode 22, the discharge between data electrode 32 and scan electrode 22 is mainly described.

Figure 6:
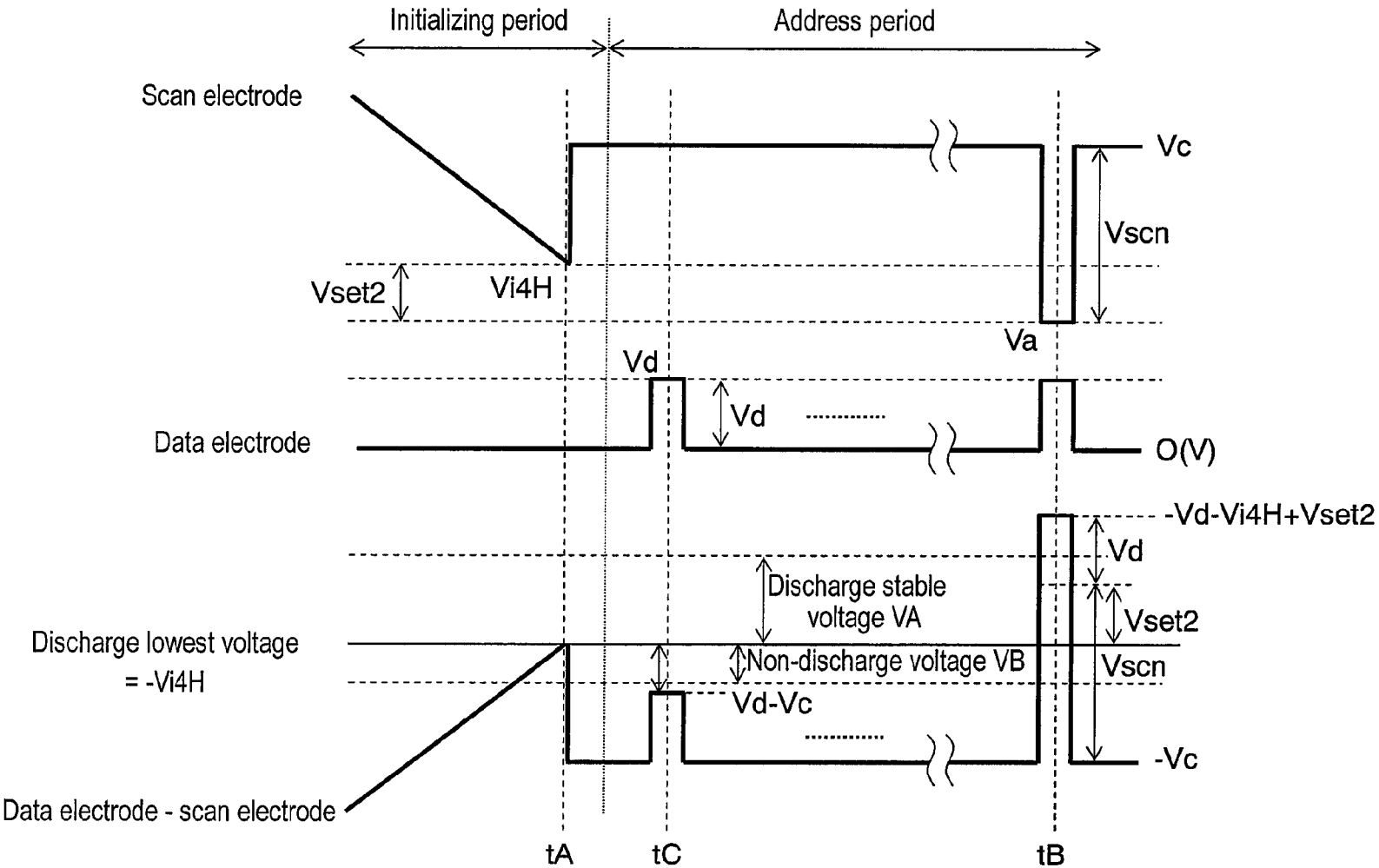
FIG. 6 is a drawing showing a driving voltage waveform applied to a data electrode and a scan electrode and a voltage change between the data electrode and the scan electrode in Embodiment 1 of the present invention.

FIG. 6 is a drawing showing a driving voltage waveform applied to data electrode 32 and scan electrode 22 and the voltage difference between data electrode 32 and scan electrode 22, that is, (driving voltage waveform applied to the data electrode)-(driving voltage waveform applied to the scan electrode), in Embodiment 1 of the present invention. Here, initializing voltage Vi4 is set to be voltage value Vi4H, and (Vc−Va) that is the amplitude of negative scan pulse voltage Va is described as a voltage larger than the voltage value (Vc−Vi4H) that is the magnitude of negative voltage Vi4H relative to positive voltage Vc by voltage value Vset2, that is, (Vc−Va)=(Vc−Vi4H)+Vset2, and that is, Va=Vi4H−Vset2. The amplitude of the scan pulse voltage (Vc−Va) is abbreviated as Vscn in the following.

At time tA right after the initializing discharge is finished, the voltage applied to data electrode 32 is 0 V, and the voltage applied to scan electrode 22 is Vi4H. Therefore, the voltage difference between data electrode 32 and scan electrode 22 is equal to (−Vi4H). In addition, the voltage in which the wall voltage is added to this voltage difference is almost equal to the discharge initial voltage. This is obvious also from that a weak initializing discharge is generated between data electrode 32 and scan electrode 22 in the initializing period till time tA. Therefore, the voltage difference between data electrode 32 and scan electrode 22 (−Vi4H) is a voltage difference at the very limit of whether the discharge is initiated or not (in the following, this voltage difference is described as a "discharge lowest voltage").

On the other hand, because negative scan pulse voltage Va is applied to scan electrode 22 and writing pulse voltage Vd is applied to data electrode 32 at time tB in which the address discharge is generated, a voltage difference of (Vd−Va), that is, (Vd−Vi4H+Vset2), is applied between data electrode 32 and scan electrode 22. Because this voltage difference is a voltage difference higher than the discharge lowest voltage (−Vi4H) by (Vd+Vset2), the address discharge occurs in the discharge cell.

However, in order to make this address discharge a stable discharge, the voltage difference between data electrode 32 and scan electrode 22 must exceed a voltage higher than the discharge lowest voltage (−Vi4H) by prescribed voltage difference (in the following, this voltage difference is described as a "discharge stable voltage") VA. That is, Vd−Vi4H+Vset2>−Vi4H+VA. That is, writing pulse voltage Vd must be $$Vd > VA - Vset2 \quad \text{(Formula 1).}$$

Further, in the state in which negative scan pulse voltage Va is not applied to scan electrode 22, for example at time tC, the voltage difference between data electrode 32 and scan electrode 22 becomes (Vd−Vc) because voltage Vc is applied to scan electrode 22 and writing pulse voltage Vd is applied to data electrode 32. The voltage difference between data electrode 32 and scan electrode 22 must be lower than the discharge lowest voltage (−Vi4H) so that an unnecessary discharge is not generated. That is, Vd−Vc<−Vi4H.

However, if the discharge cell is in the voltage state at the very limit of whether the discharge is initiated or not, the wall charges decrease by the influence of priming, an apparent dark current flows, and the wall voltage may decrease. Especially, because the time during which writing pulse voltage Vd is applied to data electrode 32 becomes long when the ratio of the discharge cell that generates emission to all discharge cells (in the following, described as a "lighting ratio") is high, the time during which the dark current flows becomes long. Therefore, in order to suppress this decrease in the wall charge, there is a necessity of making the dark current itself small. Because of this, the voltage difference between data electrode 32 and scan electrode 22 must be lower by prescribed voltage (in the following, this voltage is described as a "non-discharge voltage") VB than the discharge lowest voltage (−Vi4H) even when writing pulse voltage Vd is applied to data electrode 32. That is, Vd−Vc<−Vi4H−VB. Therefore, Vd−Vc<−(Va+Vset2)−VB, that is, it must be $$Vscn > Vset2 + VB + Vd \quad \text{(Formula 2).}$$

That is, these two conditions, $$Vd > VA - Vset2 \quad \text{(Formula 1) and}$$

$$Vscn > Vd + Vset2 + VB \quad \text{(Formula 2)}$$

must be satisfied. Therefore, in order to make amplitude Vd of the writing pulse voltage small, it is favorable to set Vset2 somewhat large. However, it must be at a level in which the address discharge is not generated in the case that scan pulse voltage Va is applied to scan electrode 22 and that writing pulse voltage Vd is not applied to data electrode 32.

The above description is an explanation on the address period of one subfield. Next, the case of in which a plurality of subfields is present and the ease of discharge differs in each subfield is described.

Here, in order to make the description simple, the description will be made using the case in which two subfields of first SF and second SF are present as an example.

Figure 7:
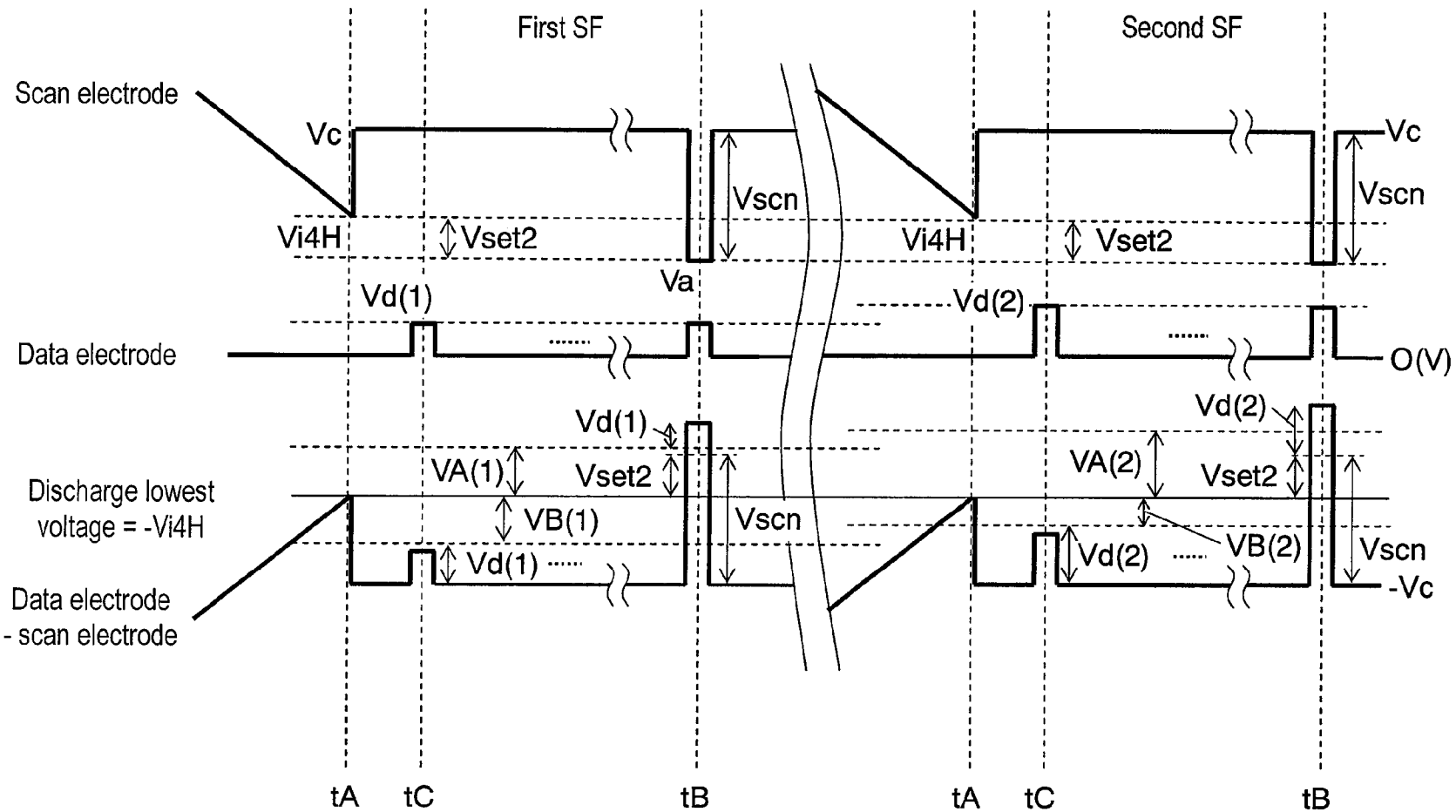
FIG. 7 is a drawing showing one example of a driving voltage waveform applied to the data electrode and the scan electrode and the voltage change between the data electrode and the scan electrode in Embodiment 1 of the present invention.

FIG. 7 is a drawing showing one example of a driving voltage waveform applied to data electrode 32 and scan electrode 22 and the voltage difference between data electrode 32 and scan electrode 22 in the case that first SF can discharge more easily than second SF in Embodiment 1 of the present invention.

In this case, one of the conditions described above must be satisfied in every subfield. That is, for first SF, $$Vd(1) > VA(1) - Vset2(1) \quad \text{(Formula 3) and}$$

$$Vscn(1) > Vd(1) + Vset2(1) + VB(1) \quad \text{(Formula 4),}$$

and for second SF, $$Vd(2) > VA(2) - Vset2(2) \quad \text{(Formula 5) and}$$

$$Vscn(2) > Vd(2) + Vset2(2) + VB(2) \quad \text{(Formula 6).}$$

As shown in FIG. 7, because first SF discharges more easily than second SF, discharge stable voltage VA (1) that is necessary to generate the stable address discharge in first SF becomes smaller than discharge stable voltage VA (2) in second SF, and non-discharge voltage VB (1) in first SF becomes larger than non-discharge voltage VB (2) in second SF.

In this way, because VA (1)<VA (2) and VB (1)>VB (2), writing pulse voltage Vd (1) in first SF can be set lower than writing pulse voltage Vd (2) in second SF. However, due to the circuit configuration, it is difficult to change writing pulse voltage Vd for every subfield, and it is not realistic because the circuit configuration becomes complex in order to realize this, and therefore, writing pulse voltage Vd is set to higher writing pulse voltage Vd (2).

Then, because Vd (1) is substituted for Vd (2) in (Formula 4), there is a possibility that (Formula 4) is not satisfied. Then, in such case, in order to satisfy (Formula 4), voltage Vc may be Vc (1) in which voltage Vc is increased by (Vd (2)−Vd (1)) as shown in FIG. 8.

Figure 8:
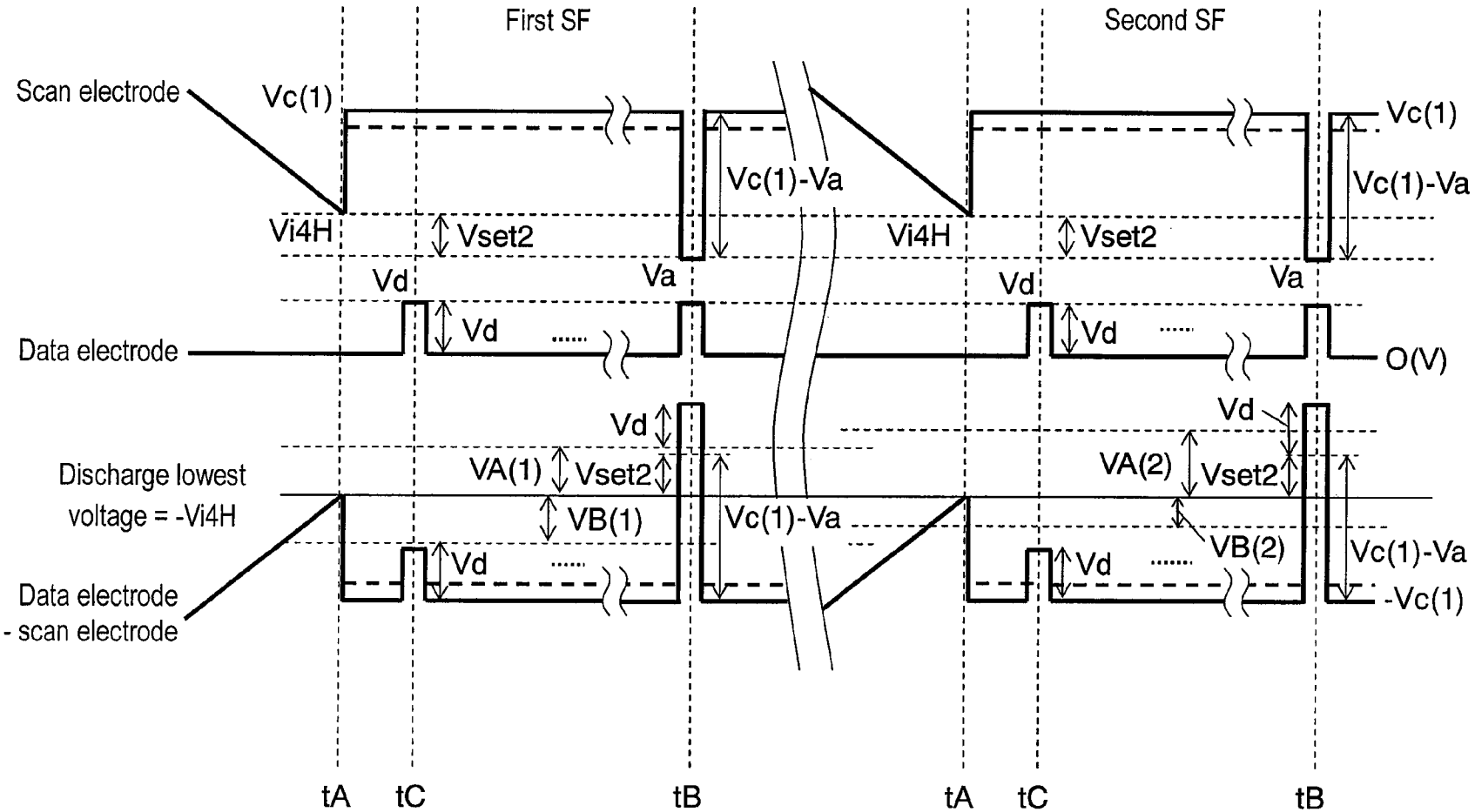
FIG. 8 is a drawing showing another example of a driving voltage waveform applied to the data electrode and the scan electrode and the voltage change between the data electrode and the scan electrode in Embodiment 1 of the present invention.

FIG. 8 is a drawing showing one example of a driving voltage waveform applied to data electrode 32 and scan electrode 22 and the voltage change between data electrode 32 and scan electrode 22 in the case that first SF can discharge more easily than second SF in Embodiment 1 of the present invention. In this case, because amplitude Vscn of the scan pulse voltage becomes (Vc (1)−Va) and large, the driving power increases and there is a case that it leads to a cost increase such as to improve voltage resistance of a part used in the driving circuit.

Then, Vset2 (1) in first SF is set to be small and initializing voltage Vi4 is made to be voltage Vi4L. In this way, writing pulse voltage Vd can be set to be small without changing potential Vc of scan electrode 22.

Figure 9:
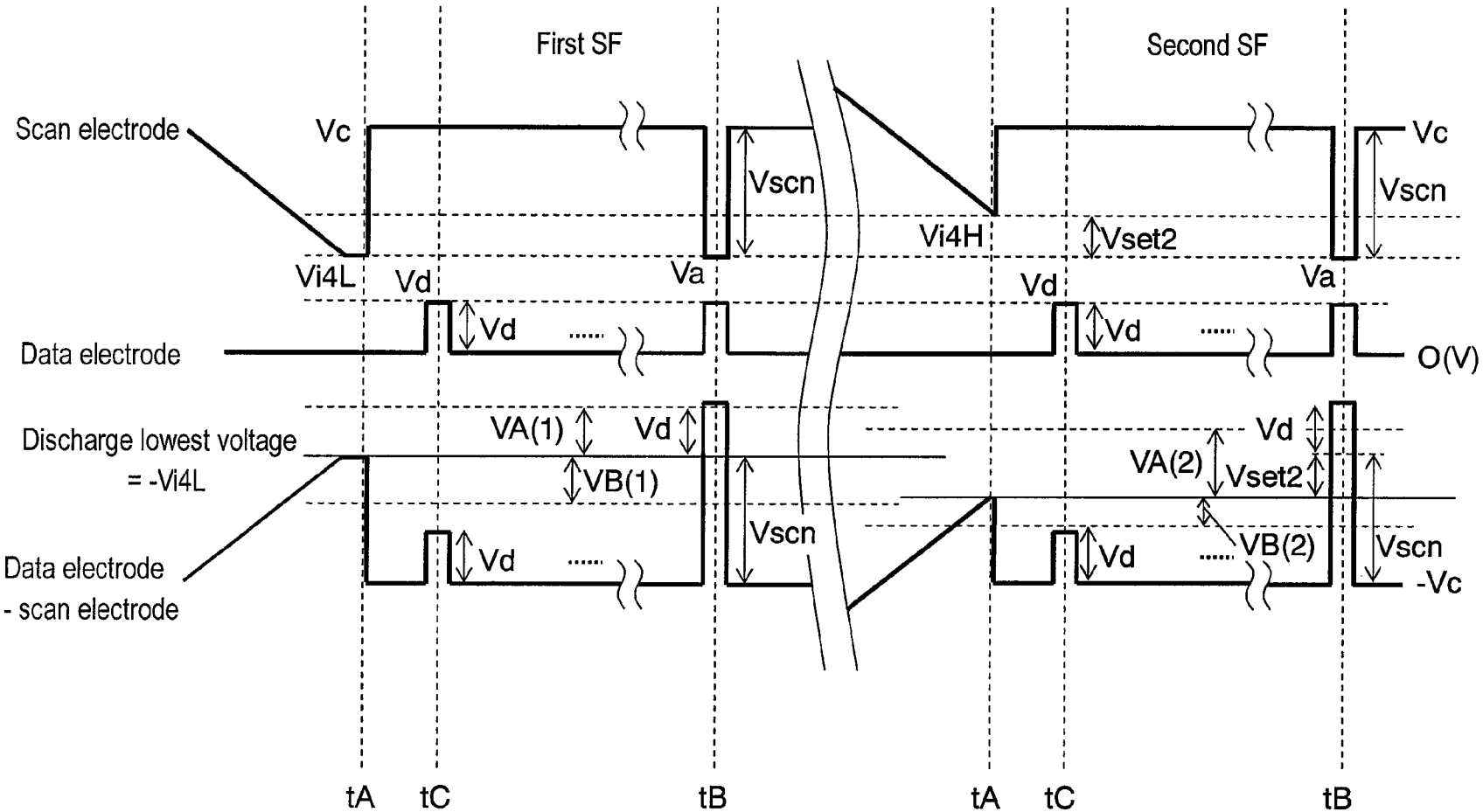
FIG. 9 is a drawing showing another example of a driving voltage waveform applied to the data electrode and the scan electrode and the voltage change between the data electrode and the scan electrode in Embodiment 1 of the present invention.

FIG. 9 is a drawing showing another example of a driving voltage waveform applied to data electrode 32 and scan electrode 22 and the voltage change between data electrode 32 and scan electrode 22 in the case that first SF can discharge more easily than second SF in Embodiment 1 of the present invention.

Here, VA (1)<VA (2) and Vset2 (1)<Vset2 (2). Then, when Vset2 (1) is set to be $$VA(2) - VA(1) = Vset2(2) - Vset2(1) \quad \text{(Formula 7), from}$$

$$Vd(1) > VA(1) - Vset2(1) \quad \text{(Formula 3) and}$$

$$Vd(2) > VA(2) - Vset2(2) \quad \text{(Formula 5),}$$

it is possible to establish Vd (1)=Vd (2).

Further, here, VB (1)>VB (2) and Vset2 (1)<Vset2 (2). Then, when Vset2 (1) is set to be $$VB(1) - VB(2) = Vset2(2) - Vset2(1) \quad \text{(Formula 8), from}$$

$$Vscn(1) > Vd(1) + Vset2(1) + VB(1) \quad \text{(Formula 4) and}$$

$$Vscn(2) > Vd(2) + Vset2(2) + VB(2) \quad \text{(Formula 6),}$$

it is possible to establish Vscn (1)=Vscn (2), and both amplitude Vd of the writing pulse voltage and amplitude Vscn of the scan pulse voltage can be made to be small as shown in FIG. 9.

Of course, (Formula 7) and (Formula 8) are not necessarily held at the same time. However, both first SF and second SF generate a stable address discharge with the voltage between data electrode 32 and scan electrode 22 exceeding discharge stable voltages VA (1) and VA (2) at time tB, the voltage between data electrode 32 and scan electrode 22 is less than non-discharge voltages VB (1) and VB (2) at time tC, and an unnecessary discharge is not generated.

Or, in the case that the voltage setting of writing pulse voltage Vd and scan pulse voltage Va is not changed, a driving margin increases and the address discharge can be stabilized further.

That is, when there is a difference in ease of discharge between subfields, there is a necessity that writing pulse voltage Vd and amplitude Vscn of the scan pulse voltage are set to the value of the subfield where they become highest, and therefore writing pulse voltage Vd and amplitude Vscn of the scan pulse voltage have to be set higher for that amount. However, each of writing pulse voltage Vd that is actually applied and amplitude Vscn of the scan pulse voltage can be set to be the minimum by adjusting the voltage of Vset2 corresponding to the ease of the discharge as described above and by making the ease of the discharge of each subfield uniform.

In the present Embodiment 1, because first SF is the all cell initializing subfield and sufficient priming is supplied in the address period of first SF, first SF is considered to be the subfield where the discharge occurs the most easily. Therefore, from the reason described above, writing pulse voltage Vd and scan pulse voltage Va is considered to be set low by setting Vset2 small in such subfield.

Then, the present Embodiment 1 is made to have a configuration of switching initializing voltage Vi4 with Vi4L and Vi4H that is higher than Vi4L by switching Vset2 corresponding to the luminance weight of the subfield, and stable writing is realized. That is, in the subfield with a small luminance weight (in the present Embodiment 1, first SF and second SF), as shown in FIG. 9, the voltage of initializing voltage Vi4 is decreased by making Vset 2 the voltage 0 V, the descending ramp waveform voltage is made to be a deep waveform, and the discharge period of the initializing discharge is made long. With this, the wall voltage is decreased by strengthening the function of weakening the wall voltage on the top part of data electrodes D1 to Dm, the deprivation of the wall charges of the discharge cell in the column that is not selected is decreased, and a stable writing operation is made to be performed. Further, in the subfield with a large luminance weight (in the present Embodiment 1, third SF to tenth SF), as shown in FIG. 8, the voltage of initializing voltage Vi4 is increased by making Vset 2 a prescribed voltage (in the present Embodiment 1, 10 V), the descending ramp waveform voltage is made to be a shallow waveform, and the discharge period of the initializing discharge is made short. With this, the wall voltage is increased by increasing the remaining amount of the wall charges on the top part of data electrodes D1 to Dm, the relative value of writing pulse voltage Vd to the discharge initial voltage is increased, and a stable address discharge is generated.

Next, in the present Embodiment 1, the reason is described that the subfield in which a voltage of initializing voltage Vi4 is Vi4L is defined as first SF and second SF and that the subfield in which a voltage of initializing voltage Vi4 is Vi4H is defined as third SF to tenth SF.

In order to investigate in which subfield Vset2 should be set low, that is, what subfield configuration is appropriate for performing the switching of initializing voltage Vi4 the most suitably, the present inventor performed an experiment to investigate scan pulse voltage Va and writing pulse voltage Vd that are necessary to perform the stable writing while changing the subfield in which the switching of initializing voltage Vi4 is performed. In this experiment, one field is divided into 10 subfields (first SF to tenth SF), and the luminance weights of (1, 2, 3, 6, 11, 18, 30, 44, 60, 80) are given to each subfield. Further, Vi4L is made to be a voltage equal to scan pulse voltage Va by making Vset2 to a voltage 0 V, and Vi4H is made to be a voltage higher than Vi4L by 10 V by making Vset2 to a prescribed voltage (10 V in the present Embodiment 1).

Figure 10A:
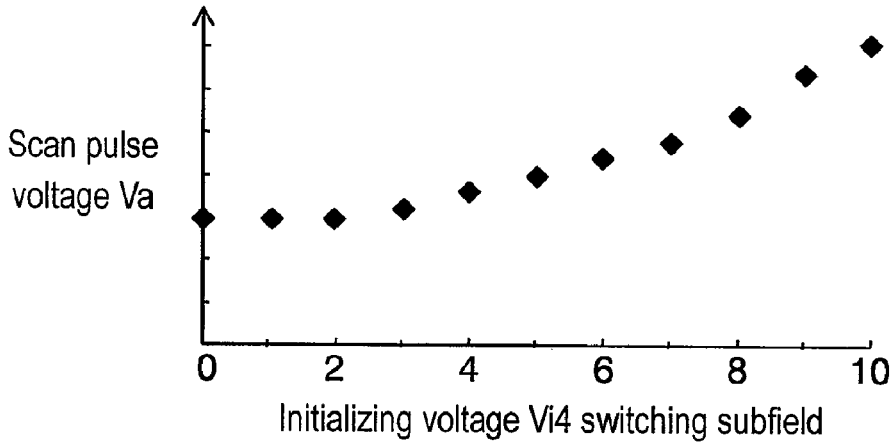
FIG. 10A is a drawing showing the relationship between a subfield that switches initializing voltage Vi4 and a scan pulse voltage in Embodiment 1 of the present invention.
Figure 10B:
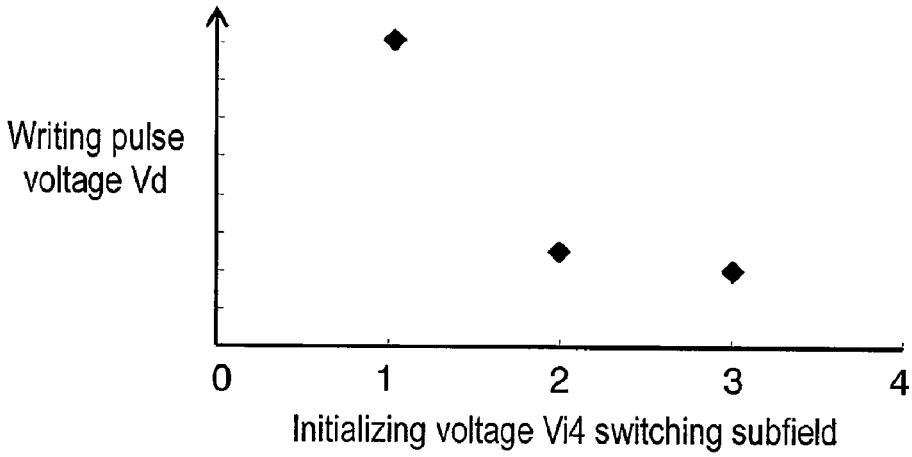
FIG. 10B is a drawing showing the relationship between a subfield that switches initializing voltage Vi4 and a writing pulse voltage in Embodiment 1 of the present invention.

FIGS. 10A and 10B are drawings in which the results of this experiment are summarized, and are drawings showing the relationship between a subfield that switches initializing voltage Vi4 and scan pulse voltage Va, and writing pulse voltage Vd. In FIGS. 10A and 10B, the x-axis shows an initializing voltage Vi4 switching subfield, the y-axis in FIG. 10A shows scan pulse voltage Va, and the y-axis in FIG. 10B shows writing pulse voltage Vd. Initializing voltage Vi4 switching subfield here represents the subfield in which initializing voltage Vi4 is switched from Vi4L to Vi4H, and for example, "2" of initializing voltage Vi4 switching subfield shows that initializing voltage Vi4 is made to be Vi4L in first SF and second SF and that initializing voltage Vi4 is made to be Vi4H in third SF to tenth SF.

As shown in FIG. 10A, when initializing voltage Vi4 switching subfield is "0" (initializing voltage Vi4 is made to be Vi4H in all subfields), "1", or "2", scan pulse voltage Va that is necessary to perform the stable writing operation hardly changes. However, on and after that, as initializing voltage Vi4 switching subfield is made larger, scan pulse voltage Va that is necessary to perform a stable writing operation gradually becomes high. Then, at initializing voltage Vi4 switching subfield "10" (initializing voltage Vi4 is made to be Vi4L in all subfields), scan pulse voltage Va that is necessary to perform a stable writing operation is about 20 V higher compared to initializing voltage Vi4 switching subfield "2".

Further, as shown in FIG. 10B, when initializing voltage Vi4 switching subfield is changed from "1" to "2", writing pulse voltage Vd that is necessary to generate a stable address discharge decreases by about 11 V. However, even if initializing voltage Vi4 switching subfield is made larger on and after that, writing pulse voltage Vd that is necessary to generate a stable address discharge hardly changes.

Then, in the present Embodiment 1, Vi4L is made to be a voltage equal to scan pulse voltage Va, Vi4H is made to be a voltage higher than Vi4L by 10 V, and initializing voltage Vi4 switching subfield is made to be "2", that is, initializing voltage Vi4 is made to be Vi4L in first SF that is a subfield with the smallest luminance weight and second SF that is a subfield with the second smallest luminance weight, and initializing voltage Vi4 is made to be Vi4H in third SF to tenth SF including tenth SF that is a subfield with the largest luminance weight. With this, scan pulse voltage Va and writing pulse voltage Vd that are necessary to perform a stable writing are decreased. Therefore, scan pulse voltage Va actually applied to scan electrodes SC1 to SCn and writing pulse voltage Vd actually applied to data electrodes D1 to Dm are increased relative to scan pulse voltage Va and writing pulse voltage Vd that are necessary to perform the stable writing, and a stable writing can be realized.

Moreover, in the present Embodiment 1, Vi4L, Vi4H, initializing voltage Vi4 switching subfield, the subfield configuration, and the like are not limited to the above-described values, and they are desirably set to the optimal values by adapting to characteristics of the panel, specifications of the plasma display device, and the like.

Next, a method of controlling initializing voltage Vi4 in the all cell initializing operation is described. Various methods can be considered to change initializing voltage Vi4. For example, it can be realized by making voltage Vi4 higher and lower by controlling steepness of the descending slope from voltage Vi3 to voltage Vi4 in FIG. 4.

One example of the method of controlling initializing voltage Vi4 in the present Embodiment 1 is described with reference to a drawing. A controlling method of initializing voltage Vi4 is described using the driving waveform at the all cell initializing operation as an example here. However, initializing voltage Vi4 can be controlled by the same controlling method in the selected initializing operation.

Figure 11:
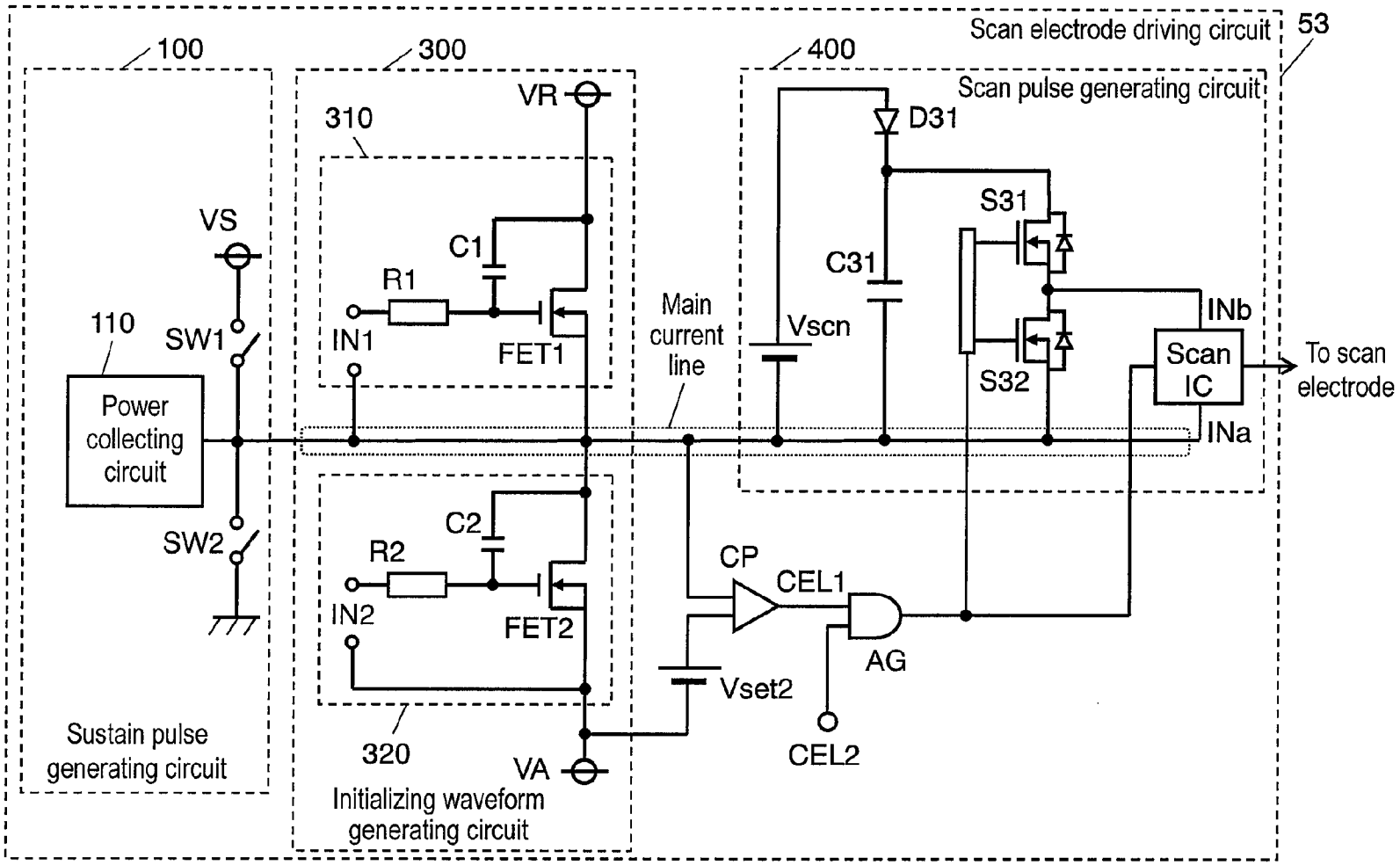
FIG. 11 is a circuit drawing of a scan electrode driving circuit in Embodiment 1 of the present invention.

FIG. 11 is a circuit drawing of scan electrode driving circuit 53 in Embodiment 1 of the present invention. Scan electrode driving circuit 53 is equipped with sustain pulse generating circuit 100 that generates the sustain pulse, initializing waveform generating circuit 300 that generates the initializing waveform, and scan pulse generating circuit 400 that generates the scan pulse.

Sustain pulse generating circuit 100 has power collecting circuit 110 to collect and reuse power when driving scan electrode 22, switching element SW1 to cramp scan electrode 22 to voltage Vs, and switching element SW2 to cramp scan electrode 22 to the voltage 0 V.

Initializing waveform generating circuit 300 is equipped with Miller integration circuits 310 and 320, generates the above-described initializing waveform, and at the same time, perform a control of initializing voltage Vi4 in the all cell initializing operation. Miller integration circuit 310 has FET1, capacitor C1, and resistance R1, and generates the ascending ramp waveform voltage gradually increasing in a ramp shape to voltage Vi2. Miller integration circuit 320 has FET2, capacitor C2, and resistance R2, and generates the descending ramp waveform voltage gradually decreasing in a ramp shape to prescribed initializing voltage Vi4. Each input terminal of Miller integration circuits 310 and 320 are shown as input terminal IN1 and input terminal IN2.

In the present Embodiment 1, the Miller integration circuit is adopted using an FET that is practical as initializing waveform generating circuit 300 and whose configuration is relatively simple. However, it is not limited to this configuration, and may be any circuit as long as it is a circuit that is capable of generating the ascending ramp waveform voltage and the descending ramp waveform voltage.

Scan pulse generating circuit 400 is equipped with switching elements S31 and S32 and Scan IC, selects one of the voltage applied to a main current line (a current line shown in a broken line in the drawing where sustain pulse generating circuit 100, initializing waveform generating circuit 300, and scan pulse generating circuit 400 are commonly connected) and the voltage in which voltage Vscn is superposed on the voltage of the main current line, and applies to the scan electrode. For example, negative scan pulse voltage Va is generated in the address period by keeping the voltage of the main current line to negative voltage Va, switching negative voltage Va input to Scan IC with voltage Vc in which voltage Vscn is superposed on negative voltage Va, and outputting the voltage.

Scan pulse generating circuit 400 outputs the voltage waveform of sustain pulse generating circuit 100 as it is in the sustain period. Further, the above-described switching elements and Scan IC consist of an element such as a generally known MOSFET for performing a switching operation, and the switching is controlled based on the timing signal output from timing generating circuit 55.

Further, scan electrode driving circuit 53 is equipped with AND gate AG that performs logic AND operation and comparator CP that compares the magnitude of the input signal that is input into two input terminals. Comparator CP compares the voltage (Va+Vset2) in which voltage Vset2 is superposed on voltage Va and the voltage of the main current line, outputs "0" in the case that the voltage of the main current line is higher, and "1" in other cases. Two input signals, that is, output signal CEL1 of comparator CP and switching signal CEL2, are input to AND gate AG. For example, a timing signal output from timing generating circuit 55 can be used as switching signal CEL 2. Then, AND gate AG outputs "1" in the case that all of the input signals are "1", and outputs "0" in other cases. The output of AND gate AG is input into scan pulse generating circuit 400, and scan pulse generating circuit 400 outputs the voltage of the main current line if the output of AND gate AG is "0", and outputs the voltage in which voltage Vscn is superposed on the voltage of the main current line if the output of AND gate AG is "1".

Next, the operation of initializing waveform generating circuit 300 is described. First, the operation in the case that initializing voltage Vi4 is made to be Vi4L is described with reference to FIG. 12, and then the operation in the case that initializing voltage Vi4 is made to be Vi4H is described with reference to FIG. 13. The description about the all cell initializing period is made in FIGS. 12 and 13. However, the descending ramp waveform voltage in the selected initializing period can be generated with the same operation as the description here. Further, in FIGS. 12 and 13, the driving voltage waveform that performs the all cell initializing operation is divided into four periods represented by period T1 to period T4, and each period is described. Further, the description is made by considering that all of voltage Vi1, voltage Vi3, and voltage Vi3' are equal to voltage Vs, that voltage Vi4L is equal to negative voltage Va, and that voltage Vi4H is equal to voltage (Va+Vset2) in which voltage Vset2 is superposed on negative voltage Va. Therefore, voltage Vi4H is a higher voltage value than scan pulse voltage Va in the address period. Further, in the following description, the operation that conducts the switching element is described as "on", and the operation cutting off the same is described as "off".

Figure 12:
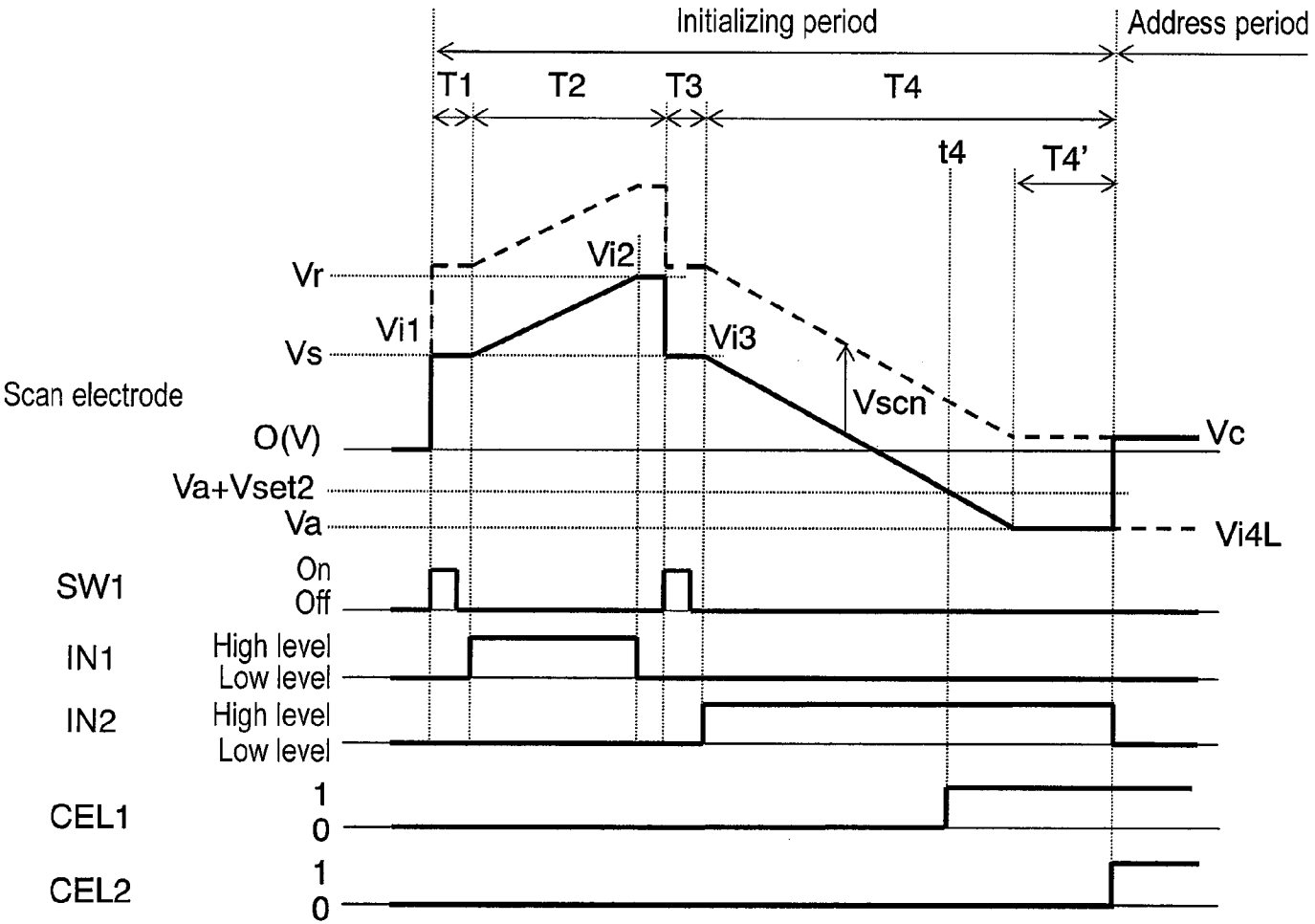
FIG. 12 is a timing chart to illustrate one example of the operation of a scan electrode driving circuit of an all cell initializing period in Embodiment 1 of the present invention.

FIG. 12 is a timing chart to illustrate one example of the operation of scan electrode driving circuit 53 of the all cell initializing period in Embodiment 1 of the present invention. Here, in order to make initializing voltage Vi4 to be Vi4L, switching signal CEL2 is kept to "0" in period T1 to period T4, and the voltage waveform of initializing waveform generating circuit 300 is output as it is from scan pulse generating circuit 400.

(Period T1)

First, switching element SW1 in sustain pulse generating circuit 100 is made to be on. Then, voltage Vs is applied to scan electrode 22 through switching element SW1. After that, switching element SW1 is made to be off.

(Period T2)

Next, input terminal IN1 of Miller integration circuit 310 is made to be a "high level". Specifically, a voltage of 15 V is applied to input terminal IN1, for example. Then, a constant current flows from resistance R1 toward capacitor C1, the source voltage of FET1 rises in a ramp shape, and the output voltage of scan electrode driving circuit 53 also starts rising in a ramp shape. Then, this voltage rise sustains while input terminal IN1 is at a "high level".

When this output voltage rises to voltage V12, input terminal IN1 is made to be a "low level" after that.

In such way, the ascending ramp waveform voltage gradually increasing from voltage Vs that is the discharge initial voltage or less (in the present Embodiment 1, it is equal to voltage Vi1, voltage Vi3, and voltage Vi3') toward voltage Vi2 exceeding the discharge initial voltage is applied to scan electrode 22.

(Period T3)

Next, switching element SW1 of sustain pulse generating circuit 100 is made to be on. Then, the voltage of scan electrode 22 decreases to voltage Vs. After that, switching element SW1 is made to be off.

(Period T4)

Next, input terminal IN2 of Miller integration circuit 320 is made to be a "high level". Specifically, a voltage of 15 V is applied to input terminal IN2, for example. Then, a constant current flows from resistance R2 toward capacitor C2, the drain voltage of FET2 falls in a ramp shape, and the output voltage of scan electrode driving circuit 53 also starts falling in a ramp shape. Then, after the output voltage reaches to prescribed negative voltage Vi4, input terminal IN2 is made to be a "low level".

At this time, in comparator CP, this descending ramp waveform voltage (the voltage of the main current line) is compared with the voltage (Va+Vset2) in which voltage Vset2 is added to voltage Va, and the output signal from comparator CP switches from "0" to "1" at time t4 when the descending ramp waveform voltage becomes the voltage (Va+Vset2) or less. However, because switching signal CEL2 is kept to "0" in period T1 to period T4, "0" is output from AND gate AG. Therefore, this descending ramp waveform voltage is outputted as it is from scan pulse generating circuit 400.

Here, the present Embodiment 1 does not switch to the subsequent address period by ending the initializing period right after the descending ramp waveform voltage has completely decreased to negative voltage Va, and period T4 is set so that a period when it is kept to negative voltage Va, that is, period T4' when the initializing waveform is kept flat, is provided. With this, measurement of the lowest voltage of the descending ramp waveform voltage becomes easy, and the voltage adjustment of initializing voltage Vi4 can be performed easily. Moreover, in the present Embodiment 1, period T4' is set to be about 20 μsec. However, it is desirable to set it to the optimal value by adapting to characteristics of the panel, specifications of the plasma display device, and easiness of adjustment.

As described above, the ascending ramp waveform voltage gradually increasing from voltage Vi1 that is the discharge initial voltage or less toward voltage Vi2 exceeding the discharge initial voltage is applied to scan electrode 22, and after that, the descending ramp waveform voltage gradually decreasing from voltage Vi3 toward initializing voltage Vi4L is applied.

Moreover, after the initializing period is completed, in the subsequent address period, the voltage of the main current line is kept at negative voltage Va. With this, the output signal from comparator CP is kept to "1". Further, in the address period, switching signal CEL2 is made to be "1". Then, the input of AND gate AG becomes also "1", and "1" is output from AND gate AG. With this, voltage Vc in which voltage Vscn is superposed on negative voltage Va is output from scan pulse generating circuit 400. Then, although not shown here, the output signal of AND gate AG becomes "0" by making switching signal CEL2 "0" at the timing of generating the negative scan pulse voltage, and negative voltage Va is outputted from scan pulse generating circuit 400. In such way, the negative scan pulse voltage in the address period can be generated.

Figure 13:
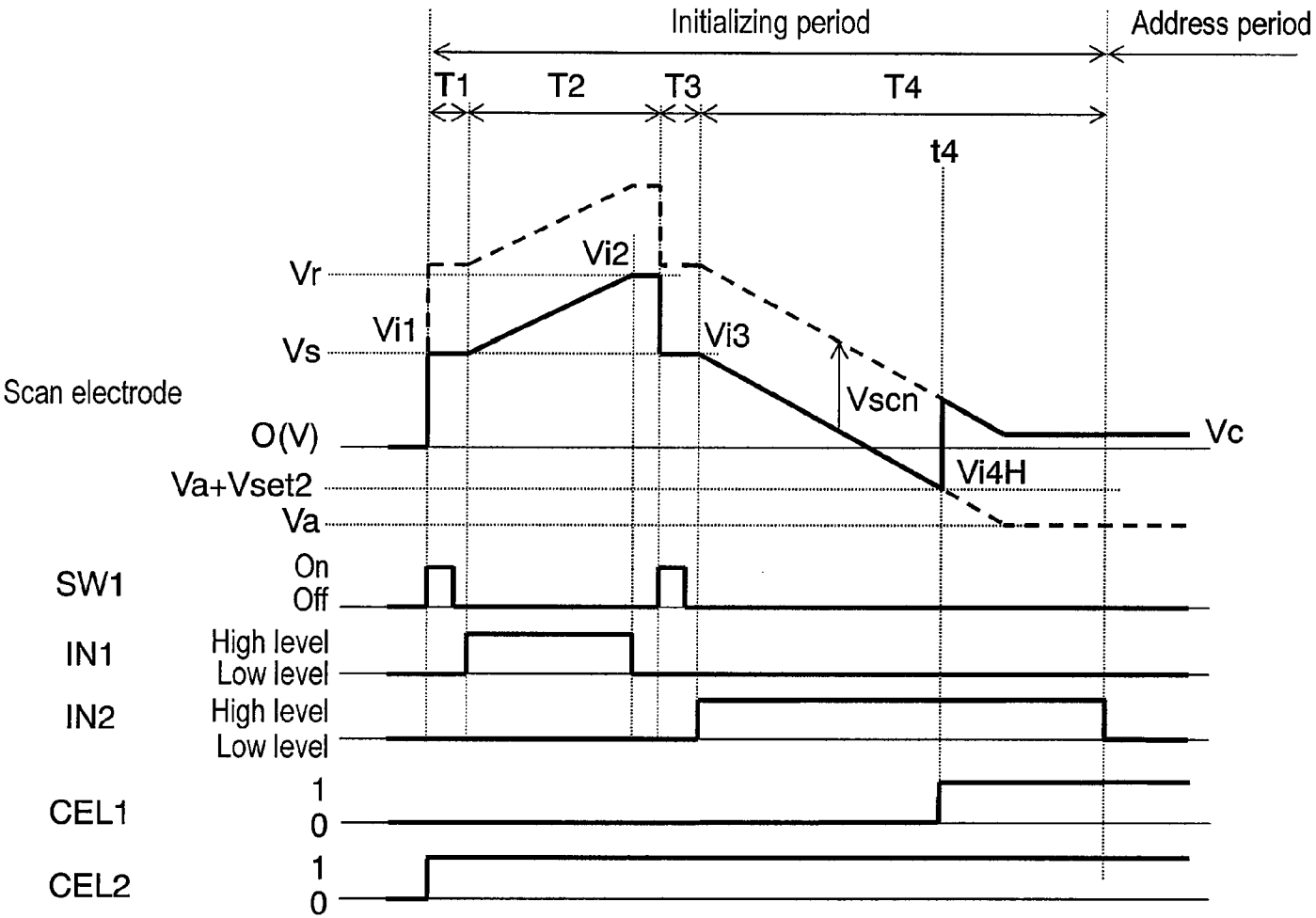
FIG. 13 is a timing chart to illustrate another example of the operation of a scan electrode driving circuit of an all cell initializing period in Embodiment 1 of the present invention.

Next, an operation in the case of making initializing voltage Vi4 to Vi4H is described with reference to FIG. 13. FIG. 13 is a timing chart to illustrate another example of the operation of scan electrode driving circuit 53 of an all cell initializing period in Embodiment 1 of the present invention. Here, in order to make initializing voltage Vi4 to Vi4H, switching signal CEL2 is made to be "1" in period T1 to period T4. Further, because the operation of period T1 to period T3 in FIG. 13 is the same as that of period T1 to period T3 shown in FIG. 12, period T4 is described here.

(Period T4)

In period T4, input terminal IN2 of Miller integration circuit 320 is made to be a "high level". Specifically, a voltage of 15 V is applied to input terminal IN2, for example. Then, a constant current flows from resistance R2 toward capacitor C2, the drain voltage of FET2 falls in a ramp shape, and the output voltage of scan electrode driving circuit 53 also starts falling in a ramp shape. Then, after the output voltage reaches prescribed negative voltage Vi4, input terminal IN2 is made to be a "low level".

At this time, in comparator CP, this descending ramp waveform voltage (the voltage of the main current line) is compared with voltage (Va+Vset2) in which voltage Vset2 is added to voltage Va, and the output signal from comparator CP switches from "0" to "1" at time t4 when the descending ramp waveform voltage becomes voltage (Va+Vset2) or less. Then, because switching signal CEL2 at this time is "1", the input of AND gate also becomes "1", and "1" is output from AND gate AG. With this, the voltage in which voltage Vscn is superposed on this descending ramp wave form voltage is output from scan pulse generating circuit 400. Therefore, the lowest voltage in this descending ramp waveform voltage can be made to be (Va+Vset2), that is, Vi4H.

In such way, in the present Embodiment 1, by making the circuit configuration of scan electrode driving circuit 53 as shown in FIG. 11, the lowest voltage of the gradually decreasing descending ramp waveform voltage, that is, a value of initializing voltage Vi4, can be controlled easily just by setting voltage Vset2 to a desired voltage value.

The control of initializing voltage Vi4 in the all cell initializing operation is described in the present Embodiment 1. However, the generation of the descending ramp waveform voltage in the selected initializing operation is the same operation as described above only with a different point that the ascending ramp waveform voltage is not generated, and the control of initializing voltage Vi4 can be performed in the same way.

Moreover, in the present Embodiment 1, the xenon partial pressure of the discharge gas is made to be 10%. However, even if it is a different xenon partial pressure, the driving voltage may be set in accordance with the panel.

Further, each specific value used in the present Embodiment 1 is nothing but one example, and it is desirable to appropriately set optimal values by adapting to characteristics of the panel, specifications of the plasma display device, and the like.

INDUSTRIAL APPLICABILITY

The drive method of a panel and the plasma display device of the present invention can generate a stable address discharge without making a voltage necessary to generate the address discharge high even in a large screen and a high luminance panel, and are useful as a drive method of a panel with a good image display quality and a plasma display device.

The invention claimed is:

1. A drive method of a plasma display panel performing image display by providing a plurality of subfields within one field period, each subfield having:

an initializing period in which a ramp-waveform voltage that is gradually descending is applied to a scan electrode;

an address period in which an address discharge is generated in a discharge cell having a display electrode pair comprising the scan electrode and a sustain electrode by applying a scan pulse voltage to the scan electrode; and a sustain period in which a sustain discharge is generated in the discharge cell by alternately applying sustain pulse voltages to the display electrode pair by the number of times corresponding to the luminance weight, the method comprising:

forming, in the initializing period of each subfield, one of:

an all cell initializing subfield that generates an initializing discharge for all discharge cells that perform image display, and a selected initializing subfield that selectively generates an initializing discharge at the discharge cell that generated a sustain discharge in the sustain period of the subfield right before, wherein the initializing period of the subfield where the luminance weight is smallest, is the all cell initializing subfield; and maintaining a lowest voltage value of the ramp-waveform voltage in both of the initializing period of the all cell initializing subfield and an initializing period of a subfield right after the all cell initializing subfield for a prescribed period, wherein the lowest voltage value of the ramp-waveform voltage in both of the initializing period of the all cell initializing subfield and the initializing period of the subfield right after the all cell initializing subfield is lower than the lowest voltage value of the ramp-waveform voltage in the initializing period of other subfields.

2. A plasma display device comprising:

a plasma display panel equipped with a plurality of discharge cells, each discharge cell having a display electrode pair comprising a scan electrode and a sustain electrode; and a driving circuit that drives the plasma display panel by providing a plurality of subfields within one field period, each subfield having:

an initializing period in which a ramp-waveform voltage that is gradually descending is applied to the scan electrode;

an address period in which an address discharge is generated in the discharge cell; and a sustain period in which a sustain discharge is generated in the discharge cell by alternately applying sustain pulse voltages to the display electrode pair by the number of times corresponding to the luminance weight, wherein the driving circuit forms, in the initializing period of each subfield, one of:

an all cell initializing subfield that generates an initializing discharge for all discharge cells that perform image display, and a selected initializing subfield that selectively generates an initializing discharge at the discharge cell that generated a sustain discharge in the sustain period of the subfield right before;

wherein the initializing period of the subfield where the luminance weight is smallest is the all cell initializing subfield;

wherein the driving circuit is configured so that the lowest voltage value in both of the initializing period of the all cell initializing subfield and an initializing period of a subfield right after the all cell initializing subfield is maintained for a prescribed period; and wherein the lowest voltage value of the ramp-waveform voltage in both of the initializing period of the all cell initializing subfield and the initializing period of the subfield right after the all cell initializing subfield is lower than the lowest voltage value of the ramp-waveform voltage in the initializing period of other subfields.

* * * * *